US009888764B2

(12) United States Patent
Xavier et al.

(10) Patent No.: US 9,888,764 B2
(45) Date of Patent: Feb. 13, 2018

(54) MAT DEVICE FOR CLEANING COSMETIC BRUSHES

(71) Applicants: Simone Rodrigues Oliveira Xavier, Fort Lauderdale, FL (US); Rene Xavier Filho, Fort Lauderdale, FL (US)

(72) Inventors: Simone Rodrigues Oliveira Xavier, Fort Lauderdale, FL (US); Rene Xavier Filho, Fort Lauderdale, FL (US)

(73) Assignee: Sigma Enterprises, LLC, New Brighton, MN (US)

( * ) Notice: Subject to any disclaimer, the term of this patent is extended or adjusted under 35 U.S.C. 154(b) by 489 days.

(21) Appl. No.: 14/514,630

(22) Filed: Oct. 15, 2014

(65) Prior Publication Data

US 2015/0027495 A1 Jan. 29, 2015

Related U.S. Application Data

(63) Continuation-in-part of application No. 14/296,100, filed on Jun. 4, 2014, now Pat. No. 9,345,379, and a continuation-in-part of application No. 13/540,090, filed on Jul. 2, 2012, now Pat. No. 9,015,895.

(51) Int. Cl.

| | |
|---|---|
| ***A46B 17/06*** | (2006.01) |
| ***A47L 13/18*** | (2006.01) |
| *A46B 9/02* | (2006.01) |

(52) U.S. Cl.

CPC ..... *A46B 17/06* (2013.01); *A47L 13/18* (2013.01); *A46B 9/021* (2013.01)

(58) Field of Classification Search

CPC ..... A46B 17/06; A47L 13/18

USPC ..... 15/227

See application file for complete search history.

(56) References Cited

U.S. PATENT DOCUMENTS

| | | | | |
|---|---|---|---|---|
| 61,841 A | | 2/1867 | Lewis | |
| 456,085 A | * | 7/1891 | Curtis | A47L 23/22 15/112 |
| 1,209,763 A | | 12/1916 | Rosengren | |
| 1,279,855 A | | 9/1918 | Garvey | |
| 1,559,114 A | | 10/1925 | Maranville | |
| 1,657,784 A | | 1/1928 | Bergstrom | |
| 1,782,502 A | | 11/1930 | Crane | |
| 1,877,527 A | | 9/1932 | Moran | |
| 1,884,659 A | | 10/1932 | Gould | |
| 1,885,572 A | | 11/1932 | Wood | |

(Continued)

FOREIGN PATENT DOCUMENTS

| | | |
|---|---|---|
| CN | 2448274 Y | 9/2001 |
| CN | 2858178 Y | 1/2007 |

(Continued)

OTHER PUBLICATIONS

Amazon, "Sigma Beauty Dry'n Shape," <https://www.amazon.com/Sigma-Beauty-D201-Dryn-Shape/dp/B0050CFD1O>, accessed Nov. 7, 2016.

(Continued)

*Primary Examiner* — Randall Chin

(74) *Attorney, Agent, or Firm* — Dorsey & Whitney LLP

(57) ABSTRACT

A brush cleaning device includes a flexible body having first and second opposed surfaces defining a top and a bottom. A plurality of different brush treatment surfaces are provided on the top of the flexible body, variously configured for washing and rinsing bristles of brushes having different sizes.

15 Claims, 19 Drawing Sheets

(56) References Cited

U.S. PATENT DOCUMENTS

| | | | | |
|---|---|---|---|---|
| 1,979,130 | A | 10/1934 | Wiley | |
| 1,984,183 | A | 12/1934 | Gillespie | |
| 2,187,430 | A | 1/1940 | Olmsted et al. | |
| D132,564 | S | 5/1942 | Lindfelt | |
| 2,325,903 | A | 8/1943 | Blair et al. | |
| 2,880,436 | A | 4/1959 | Hayden | |
| D193,090 | S * | 6/1962 | Kraines | D32/57 |
| 3,255,462 | A | 6/1966 | Antonious | |
| 3,513,061 | A | 5/1970 | Vinicki | |
| 3,648,320 | A * | 3/1972 | Woolley | A47L 23/24 15/187 |
| 3,798,698 | A | 3/1974 | Conklin, Jr. | |
| 4,154,883 | A | 5/1979 | Elias | |
| D256,181 | S | 8/1980 | Kupperman et al. | |
| D268,968 | S | 5/1983 | Sami | |
| D270,582 | S | 9/1983 | Pietrocola | |
| 4,457,640 | A | 7/1984 | Anderson | |
| 4,494,267 | A | 1/1985 | Fredley | |
| 4,621,388 | A | 11/1986 | Ortolivo | |
| D301,422 | S | 6/1989 | Schmidt | |
| 4,871,074 | A | 10/1989 | Bryson et al. | |
| D304,512 | S | 11/1989 | Byers et al. | |
| 4,980,943 | A | 1/1991 | Barber | |
| 5,022,093 | A | 6/1991 | Hall | |
| D324,541 | S | 3/1992 | Dudley | |
| D326,750 | S | 6/1992 | Druzek | |
| 5,322,056 | A | 6/1994 | Menghi et al. | |
| D354,989 | S | 1/1995 | West | |
| 5,441,355 | A | 8/1995 | Moore | |
| D363,577 | S | 10/1995 | Brightbill et al. | |
| D363,606 | S | 10/1995 | Abrahamson | |
| D375,630 | S | 11/1996 | Oliver | |
| 5,687,444 | A | 11/1997 | Hakker | |
| 5,729,858 | A * | 3/1998 | Riffel | A46B 9/02 15/111 |
| 5,815,840 | A | 10/1998 | Hamlin | |
| D401,971 | S | 12/1998 | Chang | |
| 5,898,942 | A | 5/1999 | Anderson | |
| 6,018,837 | A | 2/2000 | Andreu | |
| 6,058,882 | A | 5/2000 | Leutholt | |
| D429,860 | S | 8/2000 | Denney | |
| D439,386 | S | 3/2001 | Denney | |
| 6,264,391 | B1 | 7/2001 | Kroha | |
| D446,616 | S | 8/2001 | Denney | |
| 6,275,995 | B1 | 8/2001 | Le Gette et al. | |
| 6,460,190 | B1 | 10/2002 | Blum | |
| D468,193 | S | 1/2003 | Ohm et al. | |
| 6,560,813 | B2 | 5/2003 | Brown et al. | |
| 6,581,211 | B1 | 6/2003 | Golden | |
| D477,690 | S | 7/2003 | Howell et al. | |
| 6,669,657 | B1 | 12/2003 | Ongwela | |
| D492,816 | S | 7/2004 | Bergquist et al. | |
| 6,811,338 | B1 | 11/2004 | Manske, Jr. et al. | |
| D511,941 | S | 11/2005 | McGuyer | |
| D514,765 | S | 2/2006 | Dretzka | |
| D517,753 | S | 3/2006 | Northrop | |
| D523,192 | S | 6/2006 | Northrop | |
| D526,096 | S | 8/2006 | Kaposi | |
| D528,251 | S | 9/2006 | Lion et al. | |
| 7,117,536 | B2 | 10/2006 | Burnett et al. | |
| RE39,388 | E | 11/2006 | DeBartolo | |
| D537,997 | S | 3/2007 | Plikuhn | |
| 7,210,171 | B2 | 5/2007 | Jacobs et al. | |
| D544,264 | S | 6/2007 | Gallagher | |
| D544,665 | S | 6/2007 | Keene | |
| 7,234,170 | B2 | 6/2007 | Simic | |
| D554,331 | S | 11/2007 | Matis | |
| D556,967 | S | 12/2007 | Martins et al. | |
| D560,048 | S | 1/2008 | Snell | |
| D569,578 | S | 5/2008 | Yan | |
| D581,120 | S | 11/2008 | Sofy et al. | |
| D603,563 | S | 11/2009 | Cho | |
| D610,753 | S | 2/2010 | Moskowitz | |
| 7,681,250 | B2 | 3/2010 | Friedstrom | |
| 7,707,654 | B1 | 5/2010 | Spence | |
| D625,482 | S | 10/2010 | Yang et al. | |
| 7,823,245 | B2 | 11/2010 | Firouzman | |
| D650,522 | S | 12/2011 | Gundersen | |
| D651,408 | S | 1/2012 | Farkas | |
| D662,292 | S | 6/2012 | Meynard | |
| D667,187 | S | 9/2012 | Sowinski et al. | |
| 8,356,378 | B1 | 1/2013 | Crooms | |
| 8,371,044 | B2 | 2/2013 | Rusnak | |
| D685,560 | S | 7/2013 | Lee et al. | |
| D687,623 | S | 8/2013 | Norris | |
| D700,400 | S | 2/2014 | Saman | |
| D701,000 | S | 3/2014 | DiGirolamo et al. | |
| 8,677,544 | B1 | 3/2014 | Raven et al. | |
| D702,886 | S | 4/2014 | Bohman | |
| D703,409 | S | 4/2014 | Robbins, III et al. | |
| 8,689,387 | B2 | 4/2014 | Gundersen | |
| D707,005 | S | 6/2014 | Levy et al. | |
| 9,015,895 | B2 | 4/2015 | Filho et al. | |
| D747,628 | S | 1/2016 | Kowalczyk | |
| D747,835 | S | 1/2016 | Barnard et al. | |
| D758,666 | S | 6/2016 | Carrillo et al. | |
| D764,709 | S | 8/2016 | Filho et al. | |
| D766,511 | S | 9/2016 | Filho et al. | |
| D779,137 | S | 2/2017 | Taylor | |
| D779,140 | S | 2/2017 | Lim et al. | |
| D793,016 | S | 7/2017 | Fakier | |
| 2003/0204927 | A1* | 11/2003 | Kelly | A47K 7/026 15/160 |
| 2005/0166301 | A1 | 8/2005 | Tweel et al. | |
| 2005/0177965 | A1 | 8/2005 | Edoh | |
| 2006/0191092 | A1 | 8/2006 | O'Reilly et al. | |
| 2006/0272116 | A1 | 12/2006 | Thompson | |
| 2007/0048063 | A1 | 3/2007 | Bauer et al. | |
| 2007/0118963 | A1 | 5/2007 | Snyder | |
| 2007/0277288 | A1 | 12/2007 | Sing et al. | |
| 2008/0109933 | A1 | 5/2008 | Dolenak | |
| 2008/0178366 | A1 | 7/2008 | Daher | |
| 2008/0244848 | A1 | 10/2008 | Firouzman | |
| 2008/0283078 | A1 | 11/2008 | Dumler et al. | |
| 2009/0139007 | A1 | 6/2009 | Bevier | |
| 2010/0192318 | A1 | 8/2010 | Huizinga | |
| 2010/0218326 | A1 | 9/2010 | Yamaguchi | |
| 2011/0041276 | A1 | 2/2011 | Edwards et al. | |
| 2012/0023693 | A1 | 2/2012 | Pung et al. | |
| 2012/0060312 | A1 | 3/2012 | Kubes | |
| 2014/0000052 | A1 | 1/2014 | Filho et al. | |
| 2014/0289987 | A1 | 10/2014 | Filho et al. | |
| 2015/0027496 | A1 | 1/2015 | Xavier et al. | |

FOREIGN PATENT DOCUMENTS

| | | | |
|---|---|---|---|
| CN | 2868178 | Y | 2/2007 |
| CN | 201441347 | U | 4/2010 |
| CN | 101856156 | A | 10/2010 |
| CN | 102665485 | A | 9/2012 |
| DE | 29703954 | U | 5/1997 |
| DE | 20102840 | U1 | 6/2001 |
| EP | 2682035 | A2 | 1/2014 |
| FR | 1162308 | A | 9/1958 |
| KR | 200422216 | Y1 | 7/2006 |
| SE | 62075-0001 | | 11/1997 |
| WO | WO 02/01997 | A2 | 1/2002 |
| WO | WO2011067677 | A2 | 6/2011 |

OTHER PUBLICATIONS

Patent Examination Report No. 1 dated Nov. 25, 2016 in connection with Australian Patent Application No. 2015221549, 6 pages.

Patent Examination Report No. 1 dated Dec. 8, 2016 in connection with Australian Patent Application No. 2015221550, 7 pages.

The extended European Search Report dated Sep. 11, 2015 in connection with European Patent Application No. 14197771.0.

The extended European Search Report dated Sep. 11, 2015 in connection with European Patent Application No. 14197802.3.

Amazon.com: Norpro Pink Silicone and Fabric Glove, Medium, from Norpro. retrieved Oct. 14, 2015 from <http://www.amazon.com/gp/product/B001FB59OA?keywords=norpro%20glove&qid=1444835721&ref_=sr_1_1&sr=8-1>.

(56) References Cited

OTHER PUBLICATIONS

Norpro—Quality for the Cook. retrieved Oct. 14, 2015 from <https://we.archive.org/web/20090503194212/http://www.norpro.com/store/products/siliconefabric-oven-glove-pink>.
Norpro—Quality for the Cook. retrieved Oct. 14, 2015 from <https://we.archive.org/web/20121124064626/http://www.norpro.com/store/products/siliconefabric-oven-glove-pink>.
Extended European Search Report dated May 15, 2017 in connection with European Patent Application No. 16194837.7, 4 pages.
"Brushegg: A Compact Makeup Brush Cleaning Tool," Coffee Sundays, Article Dec. 18, 2014, retrieved Jul. 8, 2016 from <http://www.coffeesundays.com/2014/12/18/brushegg-a-compact-makeup-brush-cleaning-tool/>, 14 pages.
"Dog Grooming: Rinse Ace Bath Mitt at Drs. Foster & Smith," Review Apr. 10, 2011, retrieved Jul. 7, 2016 from <http://www.drsfostersmith.com/product/prod_display.cfm?pcatid=11101>, 4 pages.
"Makeup Brush Cleaning!" Rebekah Elizabeth, website copyright 2015, retrieved Jul. 8, 2016 from <http://rebekaheliz.com/2013/05/29/makeup-brush-cleaning/>, 5 pages.
PECO Ignores Pottstown too?, post date Jul. 1, 2010, <http://www.saveardmorecoalition.org/node/4731/peco-ignores-pottstown-too>, site visited Jul. 15, 2016, 9:57:06 PM.
Plaintiff, Prior Art Statement (Litigation Document, U.S. Pat. No. 9,015,895), dated Apr. 13, 2016.
Plaintiff, Opening Claim Chart (Litigation Document, U.S. Pat. No. 9,015,895), dated Feb. 26, 2016.
Defendants, Prior Art Statement (Litigation Document, U.S. Pat. No. 9,015,895), dated Mar. 18, 2016.
Defendants, Responsive Claim Chart (Litigation Document, U.S. Pat. No. 9,015,895), dated Mar. 18, 2016.
"2X Sigma Spa® Brush Cleaning Glove." Retrieved Dec. 14, 2015 from <https://web.archive.org/web/20140529021235/http://www.sigmabeauty.com/2X_Sigma_Spa_Brush_Cleaning_glove_p/ssg2x.htm>.
"Sigma Spa™ Brush Cleaning Glove." Retrieved Dec. 14, 2015 from <https://web.archive.org/web/20130220234830/http://www.sigmabeauty.com/Sigma_Spa_Brush_Cleaning_glove_p/bc001.htm?>.
My Makeup Issues. "Sigma Spa Brush Cleaning Glove—Review." Mar. 13, 2013. Retrieved Dec. 14, 2015 from <http://mymakeupissues.blogspot.com/2013/03/sigma-spa-brush-cleaning-glove-review.html>.
The extended European Search Report dated Oct. 22, 2015 in connection with European Patent Application No. 15170663.7.
Samanta: "New! Sigma 2X Spa Glove; the other end of the brush", May 29, 2014. Retrieved Oct. 13, 2015 from <https://theotherendofthebrush.wordpress.com/2014/05/29/new-sigma-2x-spa-glove-2/>.
Dulce Candy: "Review/Demo: 2X Sigma Spa Brush Cleaning Glove", Jun. 17, 2014. Retrieved Oct. 14, 2015 from <https://www.youtube.com/watch?v=1x04MrHPkrQ>.
Office Action dated May 11, 2015 received in connection with Chinese Application No. 201310063907.8, including English translation.
Target Mobile Site—Silicone Solutions Black Silicone Oven Mitt. <http://sites.target.com/site/en/spot/mobile_product_detail.jsp?tcin=568859&keywords=sili . . . Feb. 28, 2012.
Makeup Brush Washing Instructions: How & Why Clean Your Dirty Cosmetic Brushes. <http://www.freebeautytips.org/cleanbrushes.html> Apr. 2, 2012.
How to Clean Makeup Brushes Video and Steps. <http://www.realsimple.com/beauty-fashion/makeup/how-to-clean-makeup-brushes-0000000 Apr. 3, 2012.
How to Clean Makeup Brushes/Cleaning Guides. <http://www.howtocleanstuff.net/how-to-clean-makeup-brushes/ Apr. 2, 2012.
First Office Action dated May 4, 2017 in connection with Chinese Patent Application No. 2015104585076, 11 pages including English translation.

* cited by examiner 18
90
16
60
64
24
58
86a
86b
20
92
62
26

MAT DEVICE FOR CLEANING COSMETIC BRUSHES

CROSS-REFERENCE TO RELATED APPLICATIONS

This patent application is a continuation-in-part of U.S. patent application Ser. No. 14/296,100, filed Jun. 4, 2014, and U.S. patent application Ser. No. 13/540,090, filed Jul. 2, 2012, each of which is incorporated by reference herein, in the entirety and for all purposes. This application is related to co-pending U.S. patent application Ser. No. 14/514,635, entitled REVERSIBLE DEVICE FOR CLEANING COSMETIC BRUSHES, filed on even date herewith, now pending, and incorporated by reference herein, in the entirety and for all purposes.

FIELD

The present invention relates to cleaning implements, and more particularly to specially textured cleaning devices.

BACKGROUND

Users of cosmetic brushes are advised to clean their brushes frequently, both to enhance subsequent applications of makeup and extend the useful lives of the brushes. Frequent and proper cleaning avoids the accumulation of old makeup, skin oils and bacteria. These accumulations can undesirably affect the color of later applied makeup due to oxidation or binding with skin oils, and they may lead to skin problems or eye infections.

Cosmetic brushes frequently are cleaned by hand, applying a mixture of water and mild soap or shampoo to the bristles as the bristles are worked against the palm of the hand to expose as much bristle surface area as possible to the liquid mixture. This is followed by rinsing, typically working the bristles with the fingers while holding the bristles under running water. Typically, several repetitions of the washing and rinsing steps are necessary before clear water at the rinsing stage indicates sufficient cleaning.

Efforts to improve upon the results afforded by hand washing have led to products with textured surfaces intended to enhance wiping action along the bristles as a cosmetic brush is washed. Although these products may enhance brush cleaning through improved wiping action against the bristles, they must be held or gripped by hand, or maintained by hand against a flat surface, while the user manipulates the brush relative to the textured surface of the grid. These products feature a single grid with a single texture. There is no tailoring of the texture to suit larger brushes as opposed to smaller brushes, or to individually address the disparate needs of the washing stage and the rinsing stages. These products, whether considered alone or in combination with hand washing and rinsing, fail to address the need to remove excess moisture following cleaning.

SUMMARY

Accordingly the present invention has several aspects, each directed to one or more of the following objects:

- to provide a cosmetic brush cleaning device with a variety of surface textures tailored for washing and rinsing both larger and smaller brushes;

- to provide a cosmetic brush cleaning device usable in a manner that replicates natural movement when a cosmetic brush is washed directly by hand;
- to provide a cosmetic brush cleaning device that does not require the user's attention in terms of gripping the device or maintaining the device against a tabletop or other support surface during use; and
- to provide a cosmetic brush cleaning device that provides for post rinsing removal of residue and excess moisture from the bristles.

To achieve these and other objects, there is provided a device for washing and rinsing cosmetic brushes. In various examples and embodiments, the device may include a flexible body or mat having first and second opposed surfaces defining a top and a bottom. A plurality of different brush treatment surfaces are provided on the top surface, and variously configured for washing and rinsing bristles of brushes having different sizes. A positioning element is provided on the bottom surface, and configured to maintain a position of the device.

BRIEF DESCRIPTION OF THE DRAWINGS

For a further understanding of the above and other features and advantages, reference is made to the following detailed description and to the drawings, in which.

DETAILED DESCRIPTION

Figure 1:
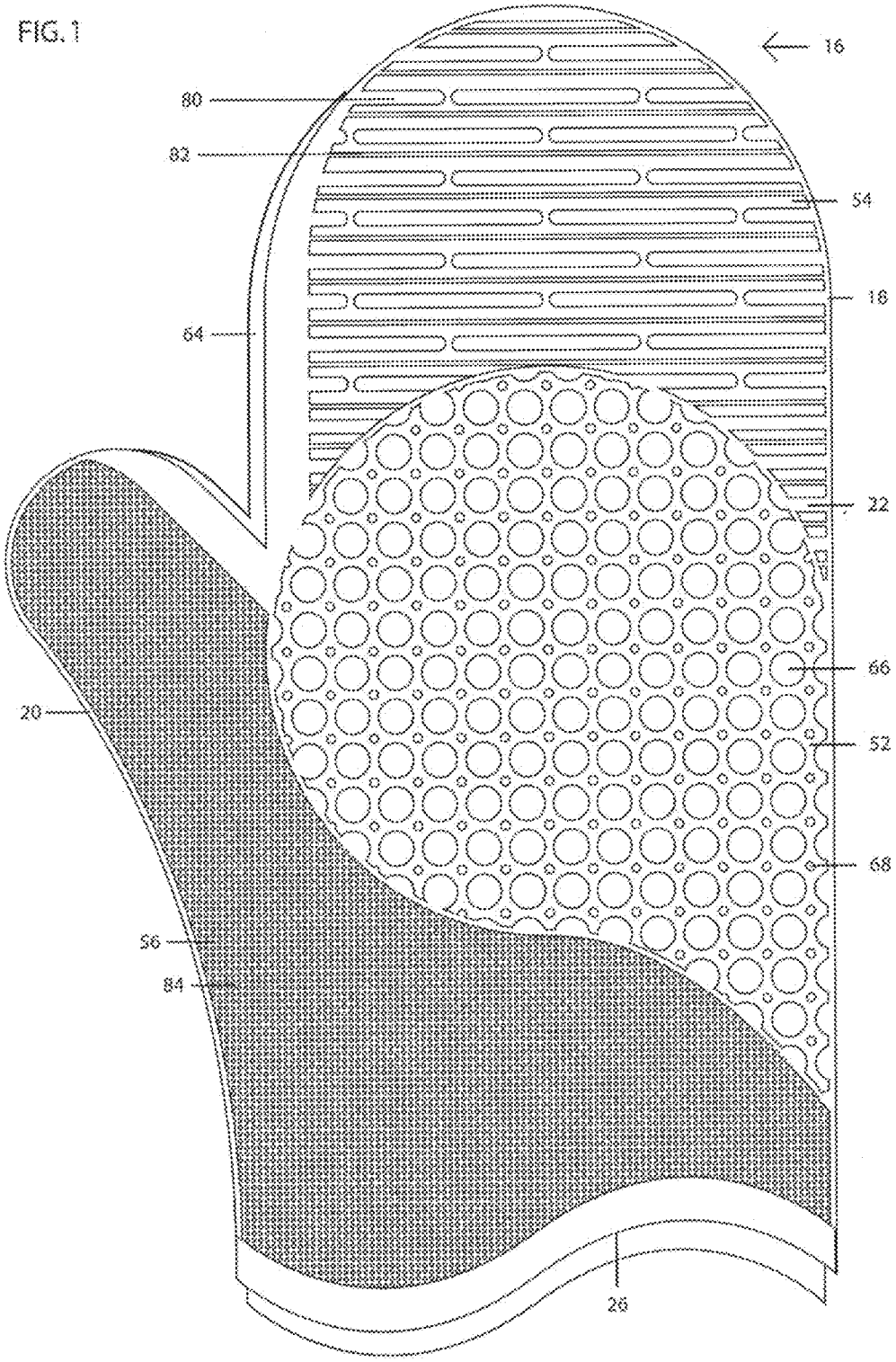
FIG. 1 is a frontal elevation of a device for cleaning cosmetic brushes, constructed in accordance with the present invention.

There is provided a device for washing and rinsing cosmetic brushes. A plurality of first texturing features are formed along a first surface region of the first exterior surface to provide a directionally neutral first texture to accommodate movement of a brush head substantially equally in all directions along the first exterior surface. A plurality of second texturing features are formed along a second surface region of the first exterior surface to provide a directionally oriented second texture adapted for movement of a brush head in a first predetermined direction along the first exterior surface.

The first texture, being directionally neutral or balanced, accommodates a circular or swirling motion of a brush head over the first surface region. Accordingly, this texture is particularly well suited to the washing stage, where the user is attempting to work a liquid cleaning solution into the bristles and expose as much bristle surface area as possible to contact with the solution.

In contrast, the second texture is directionally oriented, e.g. comprised of parallel elongate ridges or other features that promote movement of the brush head back and forth in a predetermined direction. The back and forth motion correspond to the rinsing stage, where wiping action over a maximum bristle surface area remains important, yet the need for preliminary shaping of the brush head also is taken into account.

Preferably, the first layer overlies the palmar side of the hand when the device is worn, with the first texturing features formed along the medial section and the second texturing features formed along the distal section of the enclosure. This locates the first texture over the palm. The palm is naturally preferred by the user when pushing and moving the brush head against the hand during the washing stage. The second texture is positioned along the fingers, corresponding to the user's natural tendency to work the brush head with the fingers when rinsing the brush head under running water.

In a preferred version of the device, texturing features are formed over the second layer to provide third and fourth textures overlying the dorsal side of the hand. The third and fourth textures are advantageously configured for washing and rinsing cosmetic brushes. More particularly, the first and second textures can be configured for larger brushes while the third and fourth textures are configured for smaller brushes.

Another aspect of the present invention is a device for cleaning and removing excess moisture from cosmetic brushes. A first textured surface arrangement is formed along the first exterior surface to facilitate a washing and rinsing of a cosmetic brush head by selective movement of the brush along the first textured surface arrangement.

A further aspect of the invention is a device for washing and rinsing cosmetic brushes of different types and sizes. A plurality of first texturing features are substantially evenly distributed over the first frontal surface region to provide a directionally neutral first texture to accommodate movement of a brush head substantially equally in all directions along the first frontal surface region for washing cosmetic brushes. A plurality of elongate second texturing features extends along the second frontal surface region in substantially parallel fashion. These features are substantially uniformly spaced apart to provide a directionally oriented second texture for movement of a brush head in a predetermined direction along the second frontal surface region for rinsing cosmetic brushes. A plurality of elongate third texturing features extend over the first back surface region and are oriented in different directions to provide a directionally neutral third texture for washing cosmetic brushes. A plurality of elongate fourth texturing features extend along the second back surface region in substantially parallel fashion and are substantially uniformly spaced part, to provide a directionally oriented fourth texture for rinsing cosmetic brushes.

In one preferred version of the device, the first texturing features comprise rounded nodules. Each nodule has a radius, taken at the first frontal surface region, at least as great as a nodule height taken in a direction away from the first frontal surface region. In addition, each of the second, third, and fourth texturing features has a width (taken at its associated one of the second frontal surface region, first back surface region and second back surface region) at least as great as its height in the direction away from its associated surface region. The relationship of feature radius or width to feature height results in stable features that produce effective wiping action against the bristles as the brush head is moved across the associated surface region.

In further preferred versions of the device, fifth texturing features can be formed over a third frontal surface region of the first layer, and a third back surface region of the second layer. The fifth texturing feature can comprise substantially uniformly arranged bristles, each elongate in a height direction and having a height greater than the diameter taken at its associated surface region. The bristles are laterally spaced apart adjacent bristle by a distance less than the diameter.

The structure of the bristles and their density cooperate to allow substantial penetration into the bristles of the brush head, along with effective wiping action along the bristles of the brush to remove any residue remaining after the washing and rinsing steps. The bristles are effective in cleaning residues that are difficult to remove in the washing and rinsing stages, such as liquid foundation and gel eyeliner typically applied with large and small synthetic brushes, respectively.

Nodules and ridges along the frontal and back surfaces form textures that enhance both washing and rinsing of the brush head. The bristles effectively penetrate and wipe the brush head for removal of residue remaining after washing and rinsing.

Selective shaping and arranging of the texturing features allows the device to support different washing and rinsing regions tailored to suit both larger brushes and smaller brushes, respectively. With the device worn on the hand like a mitten or glove, it does not require any attention for gripping, balancing, or otherwise maintaining the device. The user's attention can be devoted entirely to manipulating the brush head against the selected texture. Further, the textured areas can be selectively positioned on the device such that the user replicates natural hand movement and placement when a cosmetic brush is washed and rinsed directly by hand.

Yet another aspect of the invention is a device for washing and rinsing cosmetic brushes. The device includes a flexible enclosure having first and second opposed layers cooperating to define an interior space between the layers to accommodate a user's hand when inserted into the enclosure through an opening at a proximal end of the enclosure. A first textured surface arrangement is formed along the frontal surface to facilitate washing and rinsing of a cosmetic brush head by selective movement of the brush head along the first textured surface arrangement. A second textured surface arrangement is formed along the back surface to facilitate washing and rinsing a cosmetic brush head by selective movement of the brush head along the second textured surface arrangement.

Examples—Enclosed Embodiments

Figure 2:
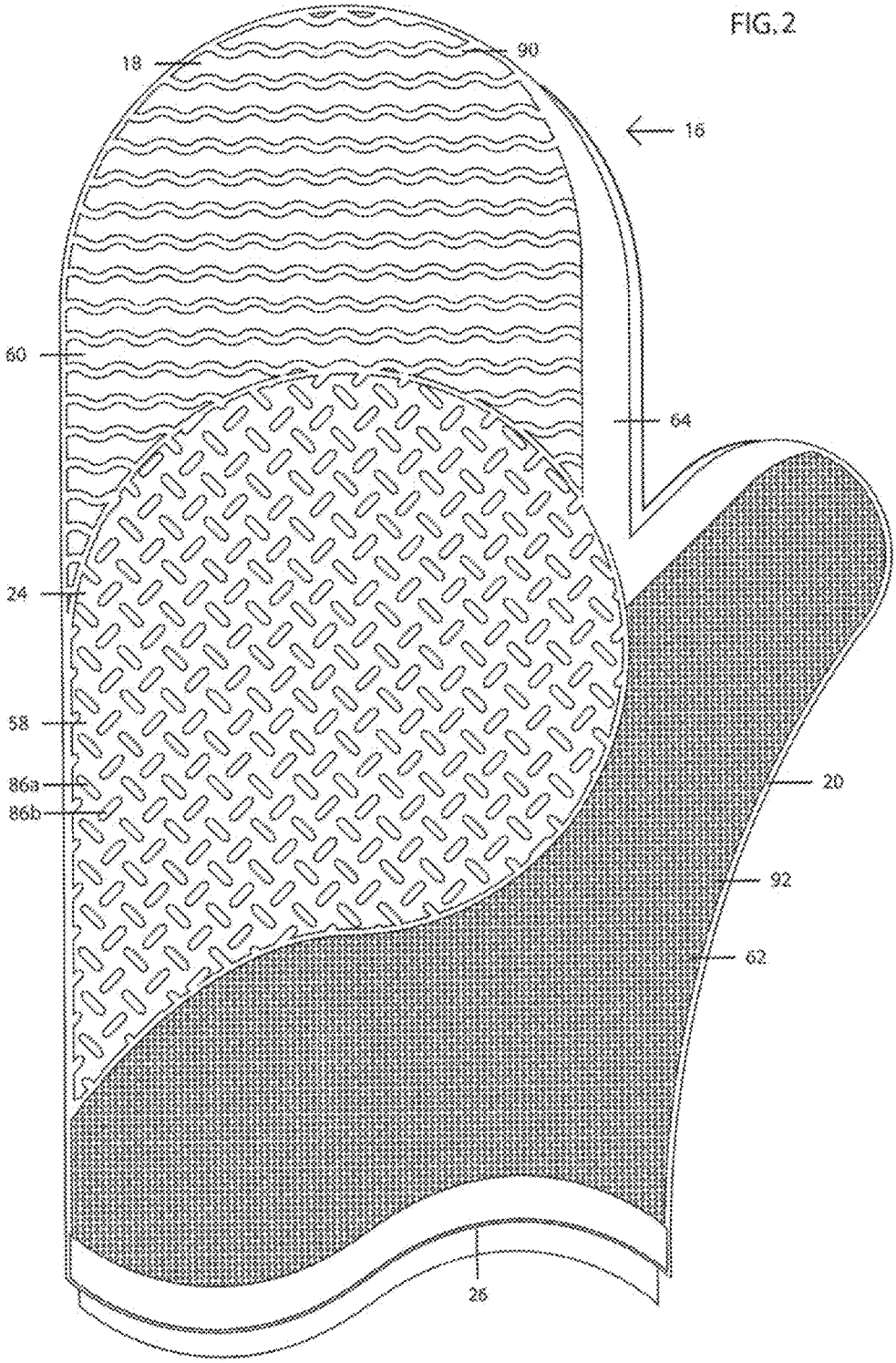
FIG. 2 is a rear elevation of the device.

Turning now to the drawings, there is shown in FIGS. 1 and 2 a device 16 for cleaning cosmetic brushes. The device is intended to be worn on the hand during use, and to that end is formed as a mitten-shaped enclosure. A main body section 18 of the device accommodates the palm and fingers (other than the thumb) and a thumb section 20 offset from the main body section accommodates the thumb. Device 16 preferably is formed of silicone rubber or another suitable elastomer to provide a favorable combination of structural integrity and flexibility, while being nonreactive and water impermeable. Another suitable material is latex.

Device 16 is homogeneous and formed as a single piece. However, in functional terms it can be considered to consist of two complementary opposed layers or panels: a frontal panel 22 and a rear panel 24. Panels 22 and 24 are joined along the periphery of device 16, except along a proximal end 26 where an opening accommodates insertion of the hand into the enclosure interior.

Device 16 can be worn on either hand, although it is designed primarily for the left hand. More particularly, frontal panel 22 is a palmar layer overlying the palm and fingers of the left hand, while rear panel 24 overlies the back of the hand and fingers.

Figure 3:
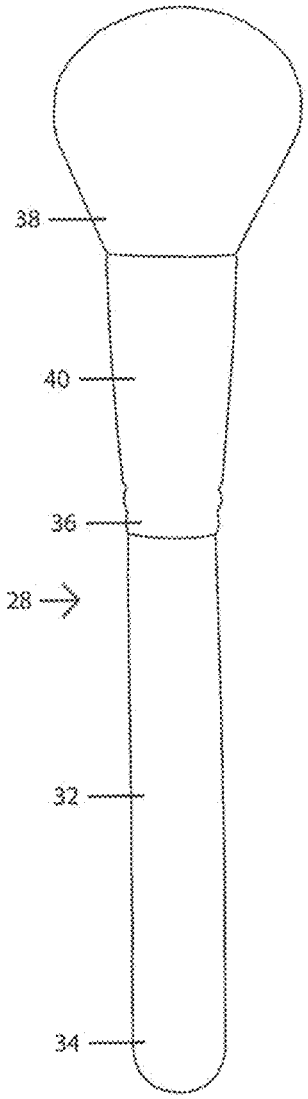
FIG. 3 is an elevation of a cosmetic brush typically used in facial applications.
Figure 4:
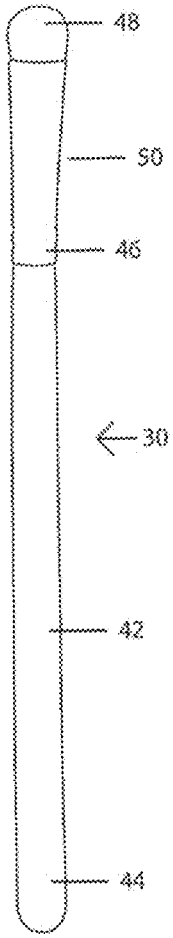
FIG. 4 is an elevation of a cosmetic brush typically used to apply eye makeup.

The exterior surface of device 16 is formed with a variety of textures for cleaning different sizes of cosmetic brushes, more particularly larger brushes such as a brush 28 shown in FIG. 3 designed to apply blush and other cosmetics to the face, and smaller brushes such as brush 30 shown in FIG. 4 used to apply eye makeup. With reference to FIG. 3, facial brush 28 includes an elongate handle 32 having a proximal end region 34 and a distal end region 36, multiple natural or synthetic bristles arranged in a bundle or head 38, and a ferrule 40 surrounding the handle and the proximal ends of the bristles. The ferrule compacts the bristles, and supports head 38 with respect to the handle. Head 38 is flared in the sense that the more centrally located bristles extend in the lengthwise direction of the handle, and the more peripheral bristles are slightly outwardly inclined while still extending generally lengthwise. The head has a circular profile in planes perpendicular to the length of the brush.

FIG. 4 illustrates brush 30 with an elongate handle 42 having a proximal end region 44 and a distal region 46, multiple natural or synthetic bristles arranged in a head 48 and a ferrule 50 compacting and supporting the bristles with respect to the handle. Again, the bristles extend at least generally in the longitudinal direction. Head 48, in contrast to head 38 of brush 28, frequently is flattened to have a linear, elliptical or other noncircular profile in planes perpendicular to the length of the brush.

The exterior surface of device 16 is formed with textures tailored to cleaning brushes 28 and 30. More particularly, the exterior surface of frontal layer panel 22 includes a textured surface region 52 for washing brush 28, a textured surface region 54 for rinsing, and a textured surface region 56 for a refining, i.e. a post-rinse removal of any residue remaining after rinsing. Similarly, the exterior surface of rear panel 24 includes a textured surface region 58 for washing brush 30, a textured surface region 60 for rinsing, and a textured surface region 62 for post-rinse residue removal.

In addition, a smooth surface region 64 is formed along adjacent portions of panels 22 and 24, extending along an index-finger side of main body section 18 and along thumb section 20. The portions of smooth surface region 64 along the main body section and thumb section confront one another. Preferably, panels 22 and 24 have an increased thickness over region 64.

Preferably, device 16 is formed by injection molding of the silicone or other elastomer to integrally form the textured surface regions via the molding process.

As noted above, the textured regions are tailored to cosmetic brushes of different sizes, with textured regions on the frontal panel suited to facial brushes and the rear panel textures suited to smaller brushes to apply eye makeup. In addition, the textured regions of each panel are individually tailored to the stages of cosmetic brush cleaning: washing, rinsing, and post-rinsing residue removal.

Figure 5:
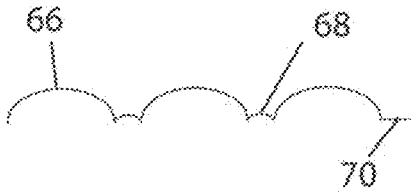
FIG. 5 schematically illustrates a brush washing texture formed along a frontal exterior surface of the device.
Figure 7:
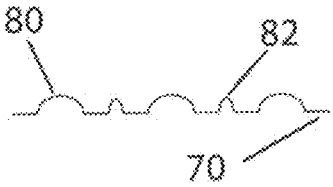
FIGS. 7 and 8 schematically illustrate rinsing and post-rinse textures formed along the frontal exterior surface of the device.
Figure 8:
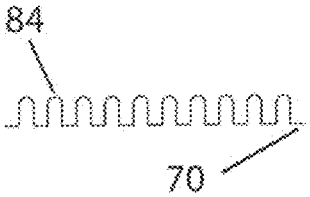

With reference to FIGS. 1 and 5, the texture of surface region 52 is formed by multiple rounded nodules of two sizes: larger nodules 66 and smaller nodules 68. Nodules 66 and 68 are intermingled, and each of the nodule sizes is evenly distributed over surface region 52.

The nodules of each size are segmented spherical in shape, defined by a segment that encompasses at most a hemispherical shape and always encompasses an outer surface of the sphere to provide rounded crown shape. In one version of device 16, larger nodules 66 extend away from a nominal surface or base 70 of the panel exterior surface, have a diameter of 8 mm (i.e. 4 mm radius) at the base, and a height of 2.5 mm in a height direction away from and normal to the base. Smaller nodules 68 have a 1 mm radius and a 1 mm height. The distribution of nodules 66 is dense such that adjacent nodules 66 are spaced apart by a distance less than their diameter. The number of small nodules formed over surface region 52 is substantially the same as the number of nodules. The nodules are arranged in a symmetrical pattern, with each large nodule surrounded by four smaller nodules, and each smaller nodule similarly surrounded symmetrically by four of the larger nodules. As a result, the texture of surface region 52 is directionally balanced or directionally neutral, in the sense that the texture provides the same resistance to the movement of a cosmetic brush head over surface region 52, regardless of the direction of brush movement along the surface.

The size, shape, density, and distribution of nodules 66 and 68 provide a favorable texture for washing brush 28 and other larger cosmetic brushes. The purpose of the washing stage is to penetrate brush head 48 with the cleaning solution, e.g. water combined with soap or shampoo, to separate adjacent bristles and expose as much bristle surface area as possible to the solution. This entails broad, vigorous circular motion and rotation of head 48 against surface region 52, while applying intense pressure to the head. The absence of an orientation, i.e. the directional neutrality of the texture, facilitates the desired circular motion and rotation. The shape of nodules 66 and 68 results in a stable texture and minimizes the potential for damage to the bristles during the washing stage. The intermingling of nodules 66 and 68 increases the area of contact with the bristles and improves the wiping action, resulting in more efficient removal of makeup from the bristles.

A salient feature of the present invention is the location of the textures on device 16 in a manner that encourages an individual to replicate hand movements and positioning that occur naturally when cleaning a brush directly by hand.

Figure 6:
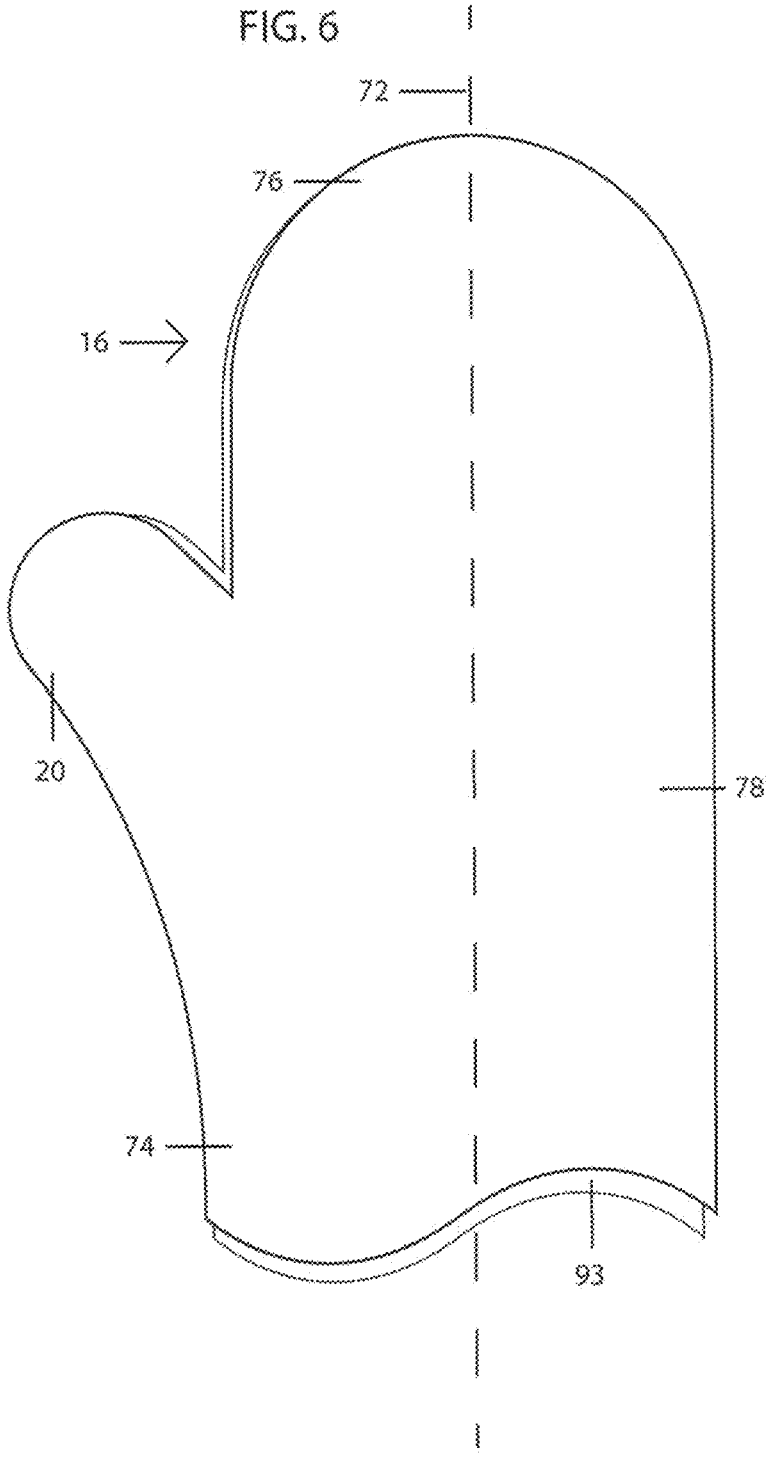
FIG. 6 is a diagrammatic frontal view of the device with broken lines indicating several different functional sections of the device.

With reference to FIG. 6, with main body section 18 disposed on a longitudinal axis 72, device 16 includes a proximal section 74 that surrounds the wrist of a user wearing the device. A distal section 76, spaced apart longitudinally from the proximal section, surrounds the fingers other than the thumb. A medial section 78 between the proximal and distal sections is disposed about the palm and back of the hand. Finally, thumb section 20 is laterally offset from medial section 78.

With reference to FIG. 1, surface region 52 corresponds substantially to that portion of medial section 78 provided by frontal panel 22. As the user presses brush head 38 against surface region 52 while moving the brush head typically in circular fashion, the surface region is backed and supported by the palm of the hand. The hand not holding the brush is positioned as if the user was cleaning the brush directly by hand. Thus, the user of the device obtains the benefits afforded by textured surface region 52 without the need for new or unusual hand positions or movements.

The texture of surface region 54 is formed by elongate transversely extending ridges or bars 80 and 82. In one version of device 16, ridges 80 are slightly over 40 mm in length and 3.25 mm wide at base 70, and have a height of 1.25 mm. Ridges 82 extend along the complete transverse width of surface region 54, with a longitudinal width of 1 mm and a height of 1 mm. Ridges 80 and 82 are intermingled or alternating, to distribute each type of ridge evenly over the surface region.

The parallel ridges form a texture particularly well suited for the rinsing stage. The movement and applied pressure of brush head 38 against the surface are not as vigorous as required in the washing stage. Nonetheless, the need remains for maximum surface contact with and good wiping action against the bristles. Also, a back and forth movement of the brush head is preferred (in lieu of the circular motion) at the rinsing stage. The reciprocal motion provides sufficient surface contact and wiping action while being less disruptive to the shape of the bristles.

In each of ridges 80 and 82, the ridge width preferably is equal to or greater than the ridge height. Further, the ridges are preferably rounded, at least over the crown or surface of each ridge remote from base 70 of the frontal exterior surface. This provides for a stable texture and minimizes the potential for damage to the bristles. Further, as brush head 38 is moved longitudinally over the ridges, the alternating size arrangement improves surface contact and wiping action, to more efficiently remove makeup residue and soap from the bristles.

With reference to FIGS. 1 and 6, surface region 54 corresponds to distal section 76, placing the rinse texture over the fingers when device 16 is worn by hand. This corresponds to the natural tendency to use the fingers when a brush is rinsed directly by hand under running water. The fingers back and support frontal panel 22 as the brush head is moved back and forth over the ridges.

Textured surface region 56 is formed with multiple bristles 84 of uniform size, uniformly and densely distributed throughout the surface region. In one version of device 16, the bristles have a diameter of 0.9 mm and a height in the direction away from base 70 of 2 mm. Adjacent bristles 84 are spaced apart by a distance of 0.6 mm to provide a high bristle density. The bristles are arranged with no selected orientation, i.e. directionally balanced or neutral. As seen in FIG. 1, surface region 56 extends along frontal panel 22 adjacent the wrist, and upwardly along thumb section 20.

The shape and density of bristles 84 provide a texture suited to removing any makeup or soap residue remaining after brush head 38 has been washed and rinsed. The need for textured surface region 56 can arise for example when liquid foundation is applied, particularly when brush head 38 is formed of synthetic bristles. Liquid foundation stains are difficult to remove from synthetic brushes, and usually are not eliminated after the washing and rinsing steps. The high density and shape of bristles 84 provides improved penetration into brush head 38 as the head is moved over the surface region, typically in back and forth fashion. The density of bristles 84 also provides greater friction for improved wiping action against the bristles of the brush head, resulting in a complete cleaning of the bristles.

After the stages of washing, rinsing, and post-rinse removal or refining, device 16 can be used to remove excess moisture from brush head 38 to substantially reduce the time required for drying the bristles. Moisture removal is accomplished by placing brush 28 between thumb section 20 and the index finger side of main body section 18, thus to position brush head 38 between confronting portions of surface region 64, particularly the base of head 38 adjacent ferrule 40. Then, with the thumb moved toward the index finger to compress surface region 64 about brush head 38, device 16 is moved relative to the brush in the direction toward the free ends of the bristles. This tends to shape brush head 38 as it removes excess moisture.

Figure 9:
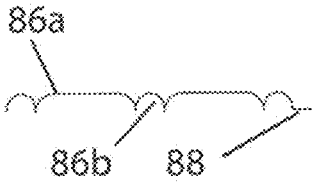
FIGS. 9 and 10 schematically illustrate washing and rinsing textures formed along a rear exterior surface of the device.

With reference to FIGS. 2 and 9, the texture of surface region 58 is formed with multiple, somewhat elongate ridges or bars 86. Ridges 86 are uniform in size and shape, but are oriented in two different directions perpendicular to each other, as indicated at 86*a* and 86*b*. In one version of device 16, ridges 86 are 5.5 mm long, 2.5 mm wide at a base 88 of the exterior surface of panel 24, and have a height of 1.25 mm in the direction away from the base.

The washing of brush head 48 is similar to the washing of brush head 38 in that strong pressure is applied to the brush head as it is moved along the textured surface region, and further in that movement of the brush head is preferably broadly circular and rotational. At the same time, brush head 48 is distinguished from brush head 38 by its smaller size and the fact that the smaller brush heads frequently are flat rather than round in transverse profile. Ridges 86, due to their width, length, and height have been found to be more efficient for washing the smaller brush heads. The desired circular and rotational motions are facilitated by the directionally balanced arrangement of ridges 86.

Figure 10:
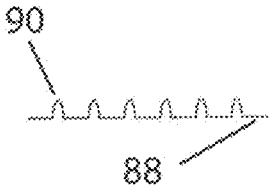

With reference to FIGS. 2 and 10, the texture of surface region 60 is formed with parallel ridges 90 that extend generally transversely yet are undulating or somewhat sinusoidal. The arrangement of the ridges is directional, to facilitate a back and forth movement of brush head 48 in the longitudinal direction over surface region 60. Brush head 48, like brush head 38 is preferably moved in back and forth or reciprocal fashion for rinsing.

The undulating or wavy ridges have been found to be more efficient than linear ridges for removal of makeup residue and soap from smaller brushes. In particular, eye brushes as compared to facial brushes are used to apply more intensely pigmented products, e.g. eye shadows, eye shadow bases, and eye liners. The undulating nature of ridges 90 has been found to better remove the residues of these products after the washing step.

As best seen in FIG. 2, the placement of textured surface region 58 on rear panel 24 corresponds to the placement of surface region 52 on frontal panel 22, in that both correspond to medial region 78. Similarly, textured surface region 60, like textured surface region 54, corresponds to distal region 76 of the device. Accordingly, when device 16 is worn on the left hand, surface region 58 overlies the back of a hand and surface region 60 overlies the dorsal side of the fingers.

The texture of surface region 62 is formed by multiple bristles 92, substantially identical in size and shape to bristles 84 and having substantially the same density. Accordingly, the texture of surface region 62 is substantially identical to the texture of surface region 56. Like surface region 56, surface region 62 extends along proximal section 74 overlying the wrist, then upwardly along thumb section 20.

For increased user comfort, device 16 can include a liner 93 (FIG. 6). The liner is formed in the shape of a mitten, to be worn by hand and disposed between the hand and the mitten-shaped enclosure when the device is in use. The liner preferably is made of cotton or another water absorbent material.

Device 16 fits either hand, but is designed primarily for wearing on the left hand while the brush being cleaned is held in the right hand to effect the desired movement of the brush head along a given surface region.

For large brushes, the washing stage typically involves applying a liquid cleaning solution to surface region 52 with the palm facing upward, then manipulating the brush head against that surface region to maximize contact of the bristles with the cleaning solution. In the rinsing stage, surface region 54 is placed under a faucet or other source of running water while the brush is manipulated with the right hand to move the brush head longitudinally back and forth over ridges 80 and 82.

In the post-rinsing stage, the brush head is moved in either circular or reciprocal fashion for the desired wiping action of the surface texture bristles against the bristles of the brush. Finally, the brush head is drawn between opposing portions of surface region 64 while the thumb and index finger cooperate to compress the brush head, thus to remove excess moisture.

The procedure for cleaning smaller brushes is substantially similar, depending on the hand used to support device 16.

It is believed that most users will prefer to keep device 16 on the left hand when cleaning a smaller brush. Thus, in the washing stage the cleaning solution is applied to back panel 24 overlying the back of the hand, rather than to the frontal panel overlying the palm. During the rinsing stage, the brush head is moved along ridges that overly the dorsal side rather than the palmar side of the fingers. In the post-rinsing stage, the user may select either surface region 56 or surface region 62, thus to support the bristles with the palm of the hand or back of the hand, as desired. Finally, the moisture removal stage for the small brush is identical to that for the large brush.

As an alternative, the user may switch device 16 to the right hand for cleaning smaller brushes, in which case surface regions 58 and 60 overlie and are supported by the palm and palmar side of the fingers, respectively.

Figure 11:
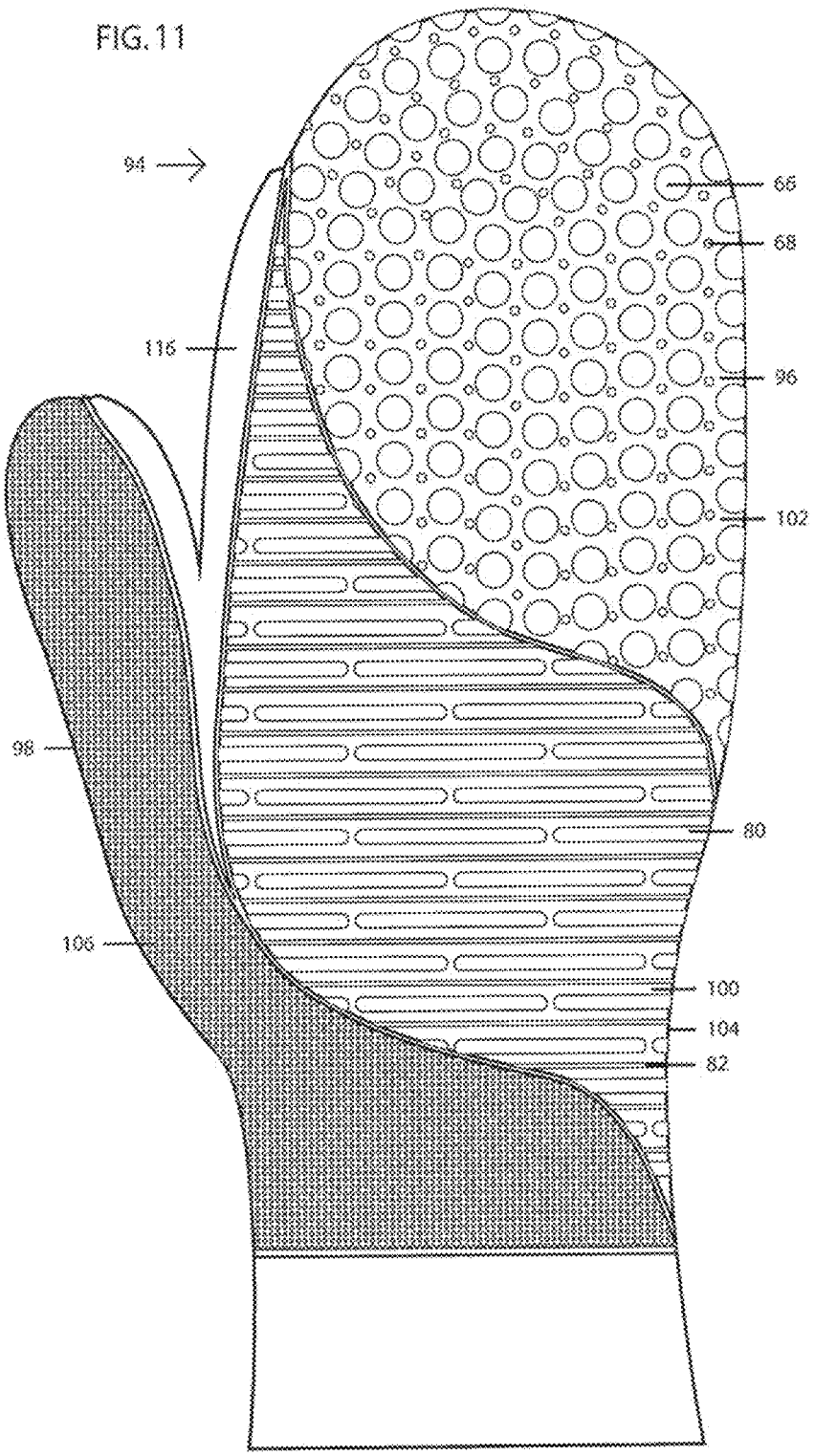
FIG. 11 is a frontal elevation of an alternative embodiment cosmetic brush cleaning device.
Figure 12:
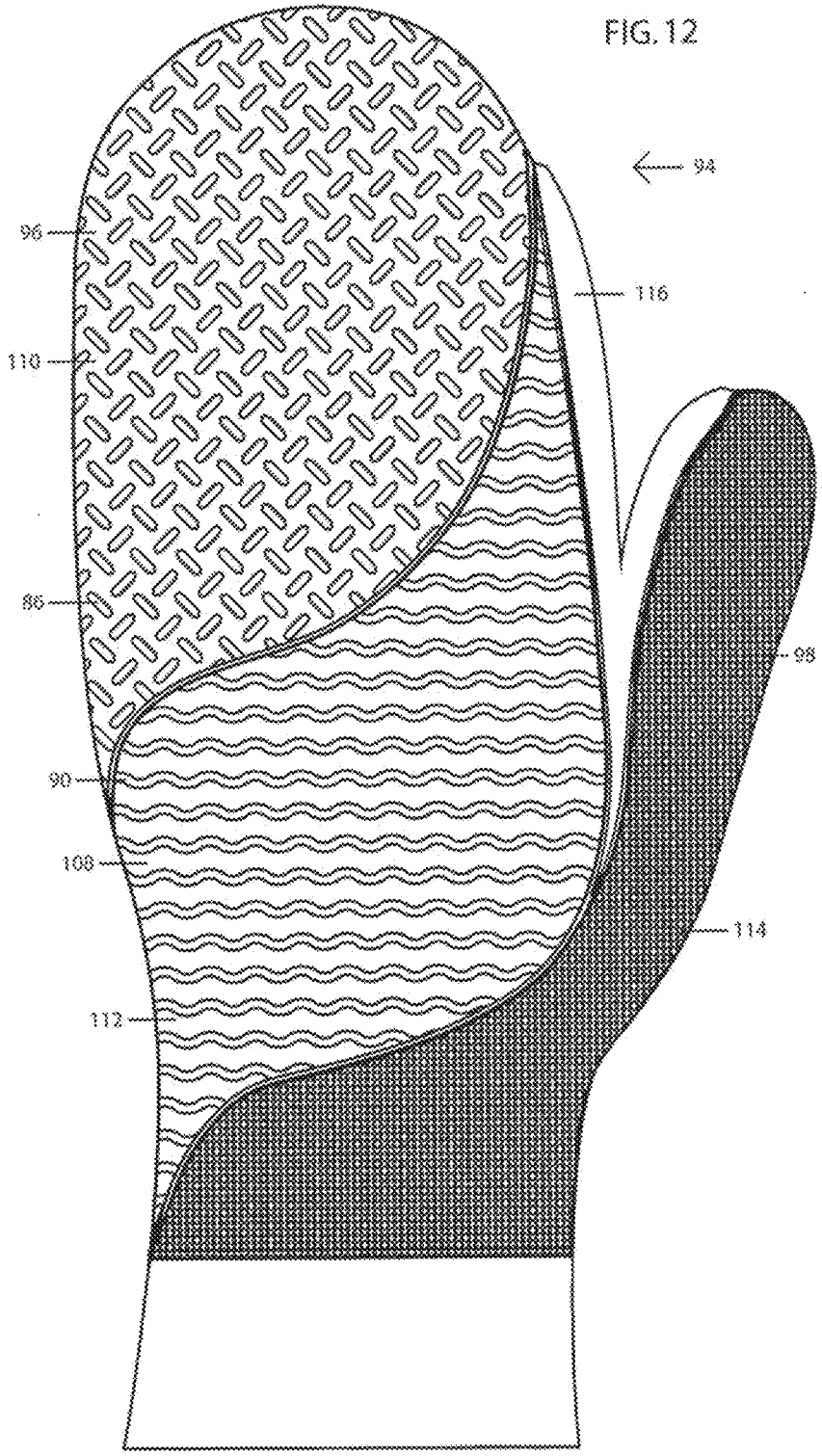
FIG. 12 is a rear elevation of the device shown in FIG. 11.

FIGS. 11 and 12 illustrate an alternative embodiment brush cleaning device 94 including a main body section 96 to accommodate the palm and fingers and a thumb section 98. A frontal panel 100 (FIG. 11) incorporates a textured surface region 102 for washing brush 28, a region 104 for rinsing, and a region 106 for post-rinsing residue removal. The exterior surface of a rear panel 108 (FIG. 12) includes a textured surface region 110 for washing brush 30, a textured region 112 for rinsing, and a textured region 114 for post-rinsing residue removal. Device 94 further incorporates a smooth surface region 116 similar to region 64 of device 16.

Device 94 differs from device 16 in that the washing regions, surface regions 102 and 110, are placed along the distal region of the device. Accordingly, these surface regions are supported by the fingers, either along the palmar or dorsal side. Rinsing surface regions 104 and 112 are supported by the palm and the back of the hand, respectively.

The brush washing and rinsing textures, while located over the fingers rather than the palm and back of the hand (and vice versa), are substantially the same. The post-rinsing surface regions likewise are substantially identical. Accordingly, device 94 is used in much the same manner as described above for device 16. Device 94 is a suitable alternative to device 16, particularly for users inclined toward more active use of the fingers in the washing stage. Nonetheless, device 16 is likely to be favored by most users, due to its preferred placement of the washing textures.

Either of devices 16 and 94 may be modified to incorporate modified textured surface regions (not shown). For example, the surface region corresponding to rinsing large brushes may incorporate transversely extending ridges of only one size. The surface region for rinsing smaller brushes may be formed with pluralities of short, spaced part transversely extending ridges in lieu of single ridges extending across the complete width of the surface region. The shorter ridges may incorporate curvature in corresponding to the undulating longer ridges. Further in alternative versions of the device, the sizes and shapes of the texturing regions can be varied, e.g. to provide a larger post-rinsing textured surface region or purely for aesthetics.

Additional Features

Some additional distinctions and advantages respect to the prior art include, but are not limited to: lower cost, smaller size, ease of transport, and reversibility, with differently configured textures on both sides. Additional textures are also included, in both reversible devices and in additional mat embodiments, for refining, shaping and finishing brushes, including larger and smaller brushes with bristles adapted for face and eye cosmetics.

As compared to the full size brush cleaning glove enclosure embodiments, the SIGMA SPA BRUSH CLEANSING GLOVE EXPRESS and mat designs described herein provide efficient, cost effective products that can easily be carried in a user's makeup bag or for travelling purposes, or used in a sink or basin. These designs may be provided in smaller or larger versions than full size gloves, but are designed to be equally or more functional, with additional advantages and features. The "express" or reversible and mat versions of the brush cleaning device may also include all the textures of the full version, with the addition of two or more additional, extra textures. In order to reduce the size and weight of the device, these textures may be distributed on one or both sides of the device, with a reversible or mat design to maximize the use of the available surfaces.

The mat device is configured for placement or attachment to the bottom surface of a sink, tub or wash basin. The reversible device has three possible points of attachment to the hand and wrist, engineered to maintain stability even during vigorous washing, rinsing and other brush treatments using rotating and back and forth (e.g., oscillating) movements of differently sized bristles across the different brush treatment textures. These attachment points or features include (1) an upper pouch or pocket, which can cover any of the user's fingers including one or more of the index, middle, ring, and small (pinkie) fingers, (2) one or two lateral thumb openings, designed to secure the glove to the thumb, and (3) a lower wrist opening, designed to position the device with respect to the user's wrist.

Upper Pocket.

The first point of attachment of the device to the hand comprises a pouch or pocket that covers and secures the device to one or more of the index, middle, ring, and small fingers. The pocket is reversible, and may have brush treatment textures on both the inner and outer sides. The dimensions of the pocket were designed and selected to provide the necessary surface to rinse brushes configured for face (side 1) and eye (reversible side 2) applications, for example by moving the bristles of the brushes back and forth or from side to side under rinsing water.

When the reversible device is used, the WASH and RINSE textures (for washing and rinsing eye and face brushes) can be located on the palm or ventral side of the hand and fingers, and the RINSE PLUS or REFINE PLUS textures (for post-rinse refining, shaping and finishing eye and face brushes) can be located on the back (dorsal) side of the hand or fingers. The rinse plus or refine plus textures for eye and face brushes cover the distal surfaces of the device corresponding to the upper pocket, and are alternately presented on the interior and exterior of depending upon the reversible orientation of the flexible body. When the mat device is used, these textures can be variously located, as described below.

One, two or more draining holes can be added to the rinse plus or refine plus portions of the device, for example at the distal end, in order to drain any water that may collect in the upper pocket during brush washing, rinsing and other bristle treatment processes. The holes can be positioned specifically at the rinse, refine, or refine plus areas to allow drainage and avoid water entering the pocket or remaining on the mat during the washing process, considering that the rinse plus or refine plus textures can also be positioned at the back of the hand when any of the alternate wash, rinse and refine textures are being used.

Lateral Thumb Opening.

The reversible device can have two laterally spaced thumb openings. These openings are configured to secure the glove in place with respect to the hand, as the several brush treatment textures are used. The lateral thumb openings or attachments are relevant when the wash textures are being used with circular motions, in which a thumb attachment can keep the glove in place even when vigorous rotating movements are being performed with brushes of various sizes being applied to the wash textures of the device. There can be two symmetrically placed thumb openings, one in each opposing side of the device. This configuration allows both right-handed and left-handed persons to use both sides of the device, in to treat brushes of different sizes.

Lower Wrist Opening.

The lower wrist opening was designed to secure the lower or proximal section of the device to the wrist, and avoid extensive movement of the device as brushes are being washed on the wash, rinse and refine or rinse plus textures or sections. Neither the thumb nor the wrist openings need add any volume or mass to the device, as the openings themselves may define a corresponding strap or loop feature configured to couple to the wrist and/or thumb (or other finger), while allowing the device to be vigorously used with minimum displacement from the hand.

Textures.

Some of the textures used in the reversible and mat devices may be substantially the same or similar to those described herein, and their locations and size may be selected to take advantage of ergonomic features. Two new textures may also be added to the reversible or "express" and mat devices: REFINE PLUS for EYES and other relatively smaller brush applications, and REFINE PLUS for FACE and other relatively larger brush applications.

The REFINE PLUS EYES texture may include a series or plurality of concentrically distributed circles, ridges or other features extending about a perimeter, that allow eye brushes to be further washed and rinsed in concentric movements. The dimensions of the circles and height of these textures are designed and selected to effectively separate the bristles of eye (smaller) brushes, allowing soap and water to deeply penetrate the bristles and remove makeup residues.

The REFINE PLUS FACE texture may include a series or plurality of closely distributed horizontal or vertical bars, for example in a substantially parallel configuration. The spacing and height of these textures are designed and selected to function as an aid to further clean face or large brushes.

The refine plus textures can be located on the back side of the upper pocket, or anywhere on the mat. These locations are selected based on the strength and support needed to further refine the bristles of differently sized brushes, for example toward the end of the washing process.

The process of washing brushes with the devices described herein typically starts in the WASH texture areas—these are areas that can be intensively and repeatedly used, until most of the makeup residues are eliminated. Due to the intensity of brush and bristle movements in these areas, the wash surfaces or textured sections can be placed at the palm of the hand, or supported against a sink or basin, where the user has more support for vigorous washing movements of the bristles against the corresponding wash textures.

Washing is typically followed by use of the RINSE textures. The rinse textures can be supported in a sink or basin or located over the fingers of the user, for example on the inside of the upper pocket, and on the front and back sides of the flexible body in the alternate configurations. These are areas of that can be innately or naturally used to rinse brushes of different sizes. These may also be areas with easy access to a water stream, for example from a faucet.

If residues are still present after rinsing, the user can move the brush to the REFINE textures. These textures are designed and selected to further remove any leftover makeup residues from the bristles. From the REFINE textures, the user may move the brush to a rinse area or a REFINE PLUS area. The refine plus textures can be designed and selected to be used as a last step for complete and fine cleansing, rinsing, shaping and finishing of the bristles. Considering that the REFINE PLUS textures may be the last areas used in the brush treatment process, the bristles may be fairly clean at this point, and the strength or force used to clean the brushes may be relatively less. Based on this rationale, the REFINE PLUS areas may be located on a periphery of the mat or on a portion of the reversible device corresponding to the back of the hand. These are areas that ergonomically may provide relatively less support than other areas of the hand (e.g. the palm or ventral side of the fingers), or in the sink or basin (e.g., in a central region near the drain hole), as used for more vigorous washing and rinsing movements of the brush and bristles against the correspondingly placed brush treatment textures.

Examples—Reversible Devices

Figure 13B:
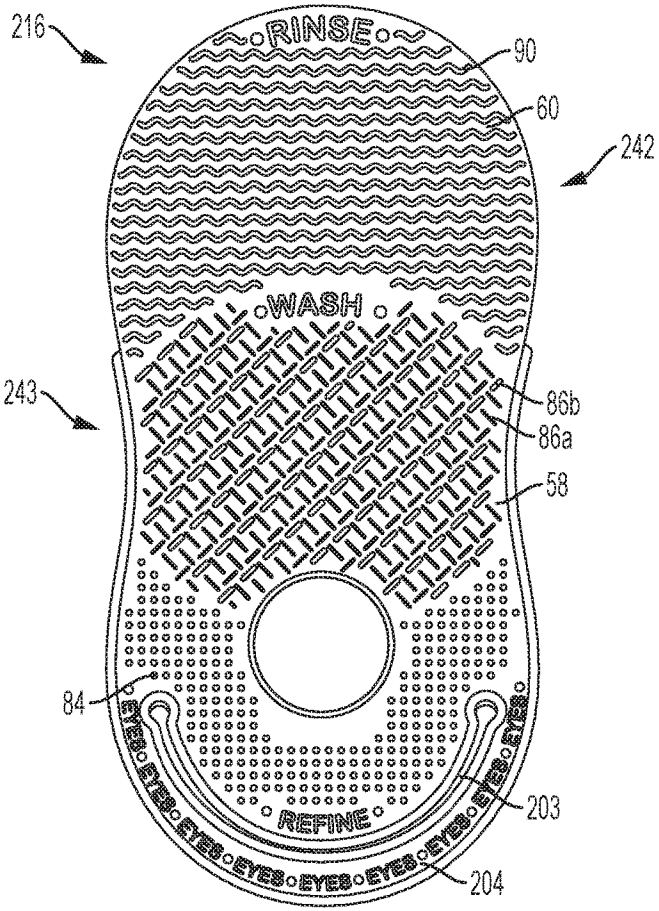
FIGS. 13A and 13B are frontal and rear elevations, respectively, of a brush cleaning device in a reversible configuration.
Figure 13A:
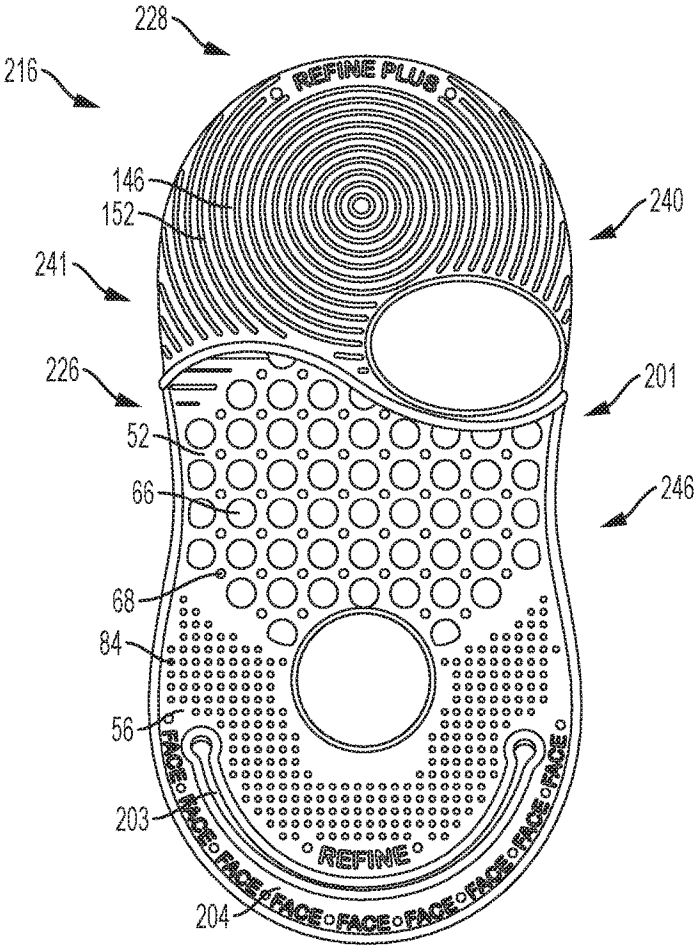

FIG. 13A illustrates an embodiment of reversible brush treatment or cleaning device 216 having a front side or portion 246, a back side or rear portion 242, and an upper pouch or pocket 201 defined between a flexible, reversible panel 241 and flexible body 243. Reversible panel 241 and flexible body 243 may be joined along the periphery of reversible panel 241, with an opening 226 along the proximal end of pocket 201. Opening 226 defines the outer and inner portions of flexible body 243, and the exterior and interior of device 216. The inner portion may accommodate the insertion of fingers into pocket 201 for various purposes including stabilizing or controlling device 216. Reversible panel 241 may be defined by first side or surface region 240 and second side or surface region 244 with alternate post-rinsing or refining brush treatment textures 136 and 146, formed on the opposite sides of reversible panel 241. Flexible body 243 may similarly be defined by a first portion or front surface region on first side 246 and a second portion or rear surface region on second side 242, e.g., formed as opposite front and back sides 246 and 242 of flexible body 243 in combination with reversible panel 241.

FIGS. 13A and 13B show front and rear views, respectively, of device 216 in a first orientation (or configuration). Device 216 may be configured to be reversible between a first and second orientation (or between corresponding first and second configurations). For example, in a first orientation, first side 240 of reversible panel 241 may be presented on the front exterior of device 216 and face away from back side 242 of flexible body 243 (on the opposite exterior side), while second side 244 of reversible panel 241 may be presented on the interior of device 216, inside pocket 201 and facing front side 246 of flexible body 236. In this configuration front side 246 of flexible body 236 is partially within the interior of device 216 defined by pocket 201, and partially exposed to the exterior.

Device 216 may be reversed from the first orientation to a second orientation, or between alternate, reversible orientations, as defined with respect to the interior and exterior of flexible body 236. This may be accomplished, for example, pushing or pulling distal end 228 of flexible body 236 through the interior of pocket 201 until device 216 inverts or alternates between the first and second orientations.

Figure 14B:
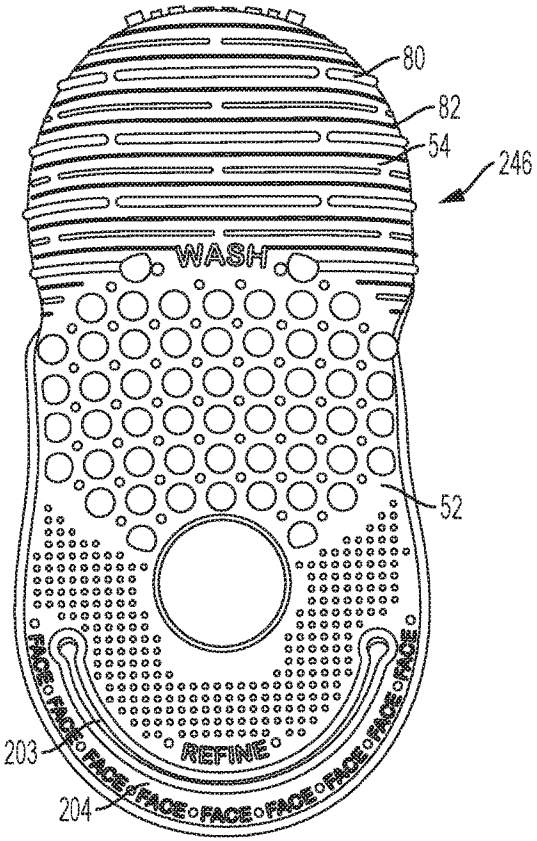
FIGS. 14A and 14B are front and rear elevations, respectively, of the reversible device.
Figure 14A:
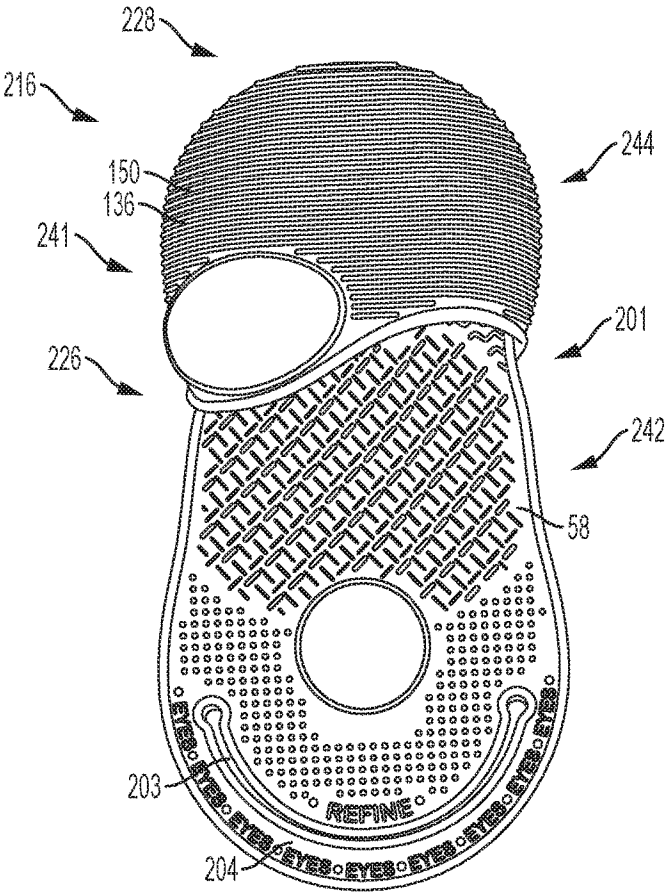

FIGS. 14A and 14B illustrate the second orientation of device 216. For example, in this configuration, the first side 240 of reversible panel 241 may be presented on the interior of device 216, and face generally toward second or back side 242 of flexible body 236. In this configuration, first side 240 of reversible panel 241 is inside pocket 201, with back side 242 partially inside pocket 201 and partially exposed to the exterior of device 216. Additionally, second side 244 of reversible panel 241 and front side 246 of flexible body 216 generally face away from each other, with second side 244 of reversible panel 241 exposed outside pocket 201 and front side 246 of flexible body 236 exposed on the opposite exterior of device 216.

The reversibility of device 216 from a first orientation to a second orientation presents several advantages. Typically cleaning surfaces would not be placed on the inside of a cleaning device because the surfaces would not be easy to access for use. Making device 216 reversible allows a user to utilize otherwise inconvenient areas of device 216, for example, textures located on an inside face of pocket 201. In addition, reversibility allows more surface area of device 216 to have easily accessible cleaning textures, allowing for device 216 to be created with, for example, a less-encompassing enclosure, which can result in a smaller overall size of device 216. This configuration may be less costly to manufacture, weigh less, and be easier for a user to carry or operate. This configuration also allows for more or different cleaning textures to be available for use even on a relatively small device. In addition, the presence of a textured surface on the interior of pocket 201 can allow for the user's fingers to better grip the interior surface of pocket 201, which may be beneficial when using device 216 with soapy water or other slippery substances.

In these embodiments, reversible brush treatment device 216 may be formed of a flexible body 243 with front and back surfaces or sides 246 and 242 extending from a proximal portion at opening 203 through a medial portion to distal end 228, with interior or pocket 201 formed by reversible panel 241. Flexible body 243 has first and second alternate, reversible orientations, as defined with respect to the interior and exterior of device 216 defined by pocket 210, and with respect to the front and back surfaces on opposite sides 246 and 242.

Different brush treatment textures are defined in different surface regions of flexible body 243, for example two-dimensional arrays of symmetrically arranged brush washing features such as bumps or nodules 66 and 68 with various round, circular, oval, oblate, lobed or other features defined in medial surface region 52 on front side 246 of flexible body 243, or a symmetrical grid of intersecting, interrupted ridges or bars 86*a* and 86*b* defined in the opposite medial surface region 58, on back side 242 of flexible body 243. Additional brush treatment textures include elongated brush rinsing features such as generally parallel ridges or bars 80, 82 and 90 in distal surface regions 54 and 60 on front and back sides 246 and 242 of flexible body 243, respectively, and elongate bars or ridges 150 and 152 configured for additional rinsing or post-rinse refining and shaping in distal surface regions 136 and 146 on opposite sides 244 and 240 of reversible panel 241, defining the alternate interior and exterior surfaces of pocket 201 in the distal portion of flexible body 243, as described above. In some embodiments, additional patterns such as stippling or bristles 84 may be provided proximal region 56 of flexible body 243, on one or both of front and back sides 246 and 242.

For example, a first brush treatment texture or pattern of generally parallel or concentric ridges or other elongated features 90 or 152 may be defined in a first (e.g., distal) surface region 60 or 146 of flexible body 216, and a second brush treatment texture or pattern of generally parallel ridges or bars 80, 82 or 150 may be defined in a second (e.g., distal) surface region 54 or 136 of the flexible body.

These patterns may be provided on distal regions 54, 60, 136 and 146 on front side 246 or back side 242 of flexible body, or on the first or second alternate surfaces 240 and 244 of reversible panel 241 defining pocket 201 in distal portion 228 of device 218. Thus, the reversible orientations of device 216 and flexible body 243 alternately present the first and second surface regions 54/60 and 136/146 on the exterior and interior of flexible body 243, respectively, with the various first and second brush treatment textures 80, 82, 90, 150 and 152 being different configured to provide for alternate brush treatments in each of the reversible orientations. For example, the various first and second brush treatment textures 80, 82, 90, 150 and 152 may be configured with relatively smaller and relatively larger scale, features, or spacing, as selected for treating relatively smaller and relatively larger brushes in each of the reversible orientations.

A loop or strap 204 may be presented on flexible body 243, e.g., in proximal portion 56, and configured to retain flexible body 243 on a user's hand. For example, the user's hand may be inserted through opening 203, as defined by a continuous strap 243 attached to proximal portion 56 of flexible body 243 on opposing ends, with the user's fingers inserted into the interior of device 216 at distal end portion 228 of flexible body 243 as shown in FIGS. 15A-B and 16A-B, below. In additional examples, opening 203 may be formed in flexible body 243 to define a corresponding loop or strap structure 243, and configured to retain the user's wrist with respect to proximal portion 56 with the user's fingers inserted into the interior of pocket 21 in distal portion 228 of flexible body 243.

As shown in FIGS. 13A-B and 14A-B, distal end 218 of flexible body 243 is defined opposite proximal portion or end 56, along the vertical axis or longitudinal dimension of device 216. Medial portions 52 and 58 of flexible body 243 are defined between proximal portion 56 and distal portions 54 and 60, on opposite sides 246 and 242 of device 216, respectively.

Figure 17C:
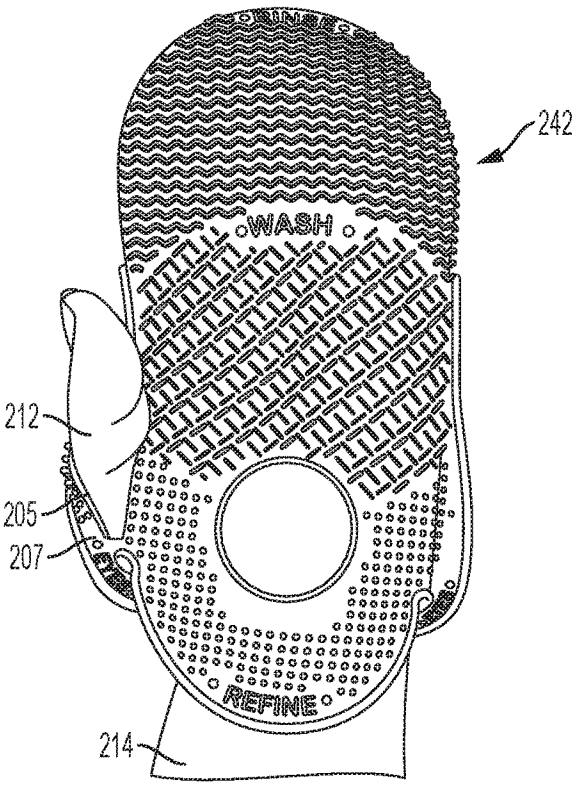
FIGS. 17B and 17C are side and rear views of the device in FIG. 17A, respectively, being worn on a hand.
Figure 17B:
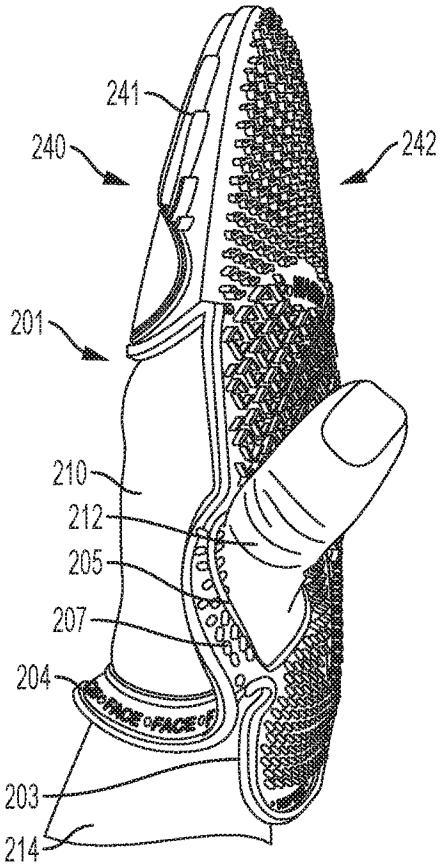
Figure 17A:
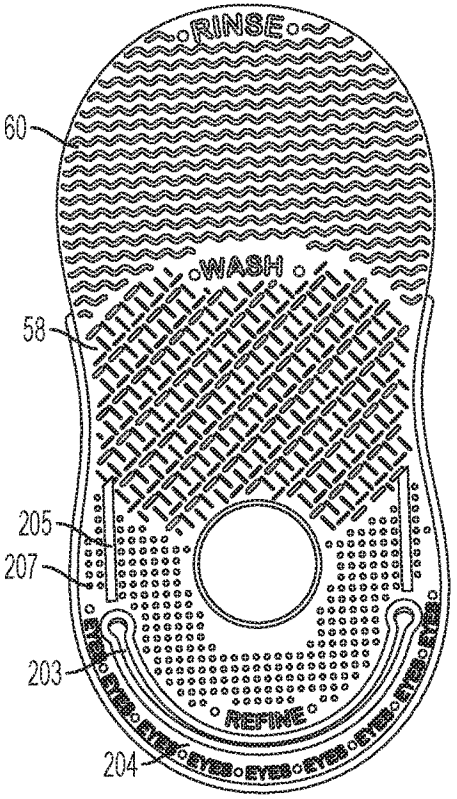
FIG. 17A is a rear view of the reversible device, in an embodiment with symmetric thumb slots.

Loop 204 and opening 203 are reversibly defined between the alternate orientations of flexible body 243, with the user's wrist inserted through opening 203 and the fingers positioned within pocket 201. Pocket 201 defines the interior of flexible body 243, for example between second side 244 of reversible panel 241 and first (front) side 246 of flexible body 243. In this (first) configuration, brush refining texture 152 is presented on the exterior of device 216, in region 146 on first side 240 of reversible panel 241 as shown in FIG. 13A. In the second (alternate or reversed) configuration, the interior of flexible body 243 is defined between first side 240 of reversible panel 241 and second (back) side 242 of flexible body 243, and alternate brush refining texture 150 is presented on the exterior of device 216, in region 136 on second side 244 of reversible panel 241 as shown in FIG. 14A. Reversible device 316 may also include a pair of lateral thumb openings (e.g., slits, slots or other apertures) 205 defined in flexible body 243, configured to retain the user's thumb in each of the alternate orientations of device 216 as shown in FIGS. 17A-17C (below).

Proximal portion 56 of flexible body 413 is thus configured for positioning device 10 with respect to the user's wrist. Medial portions 52 and 58 are configured for positioning device 10 with respect to the front (palm) or back of the user's hand, and distal portion 228 is configured for retaining one or more of the user's fingers (either including or excluding the thumb), for example in pocket 201.

Distal portion 228 of flexible body 243 includes pocket 201 configured for retaining the user's fingers, with brush and bristle refining, shaping and finishing surface regions 146 and 136 (textures 152 and 150) on first and second surface regions (or sides) 240 and 244 of reversible panel 241, respectively. Distal portion 228 also includes brush and bristle rinsing surfaces 54 and 60 (textures 80, 82 and 90) on front and back sides 346 and 242 of flexible body 243, respectively. Texture patterns 152 and 150 on surface regions 146 and 136 are reversible between the exterior and interior of device 10, according to the reversible configurations of flexible body 243 with first and second sides 240 and 244 of flexible panel 201 presented on the outside and inside of pocket 201, respectively.

Similarly, brush and bristle rinsing texture patterns 80/82 and 90 on front and back distal surface regions 54 and 60 are also reversible between the exterior and the interior of device 10. Brush and bristle washing texture patterns 66/68 and 86*a*/86*b* are reversibly presented on medial front and back surface regions 52 and 58, respectively, again according to the alternate, reversible configurations of flexible body 243 and pocket 201 as defined by reversible panel 241.

In this particular embodiment, brush and bristle washing texture regions 52 and 58 each comprise a plurality of symmetrically arranged features 66/68 and 86*a*/86*b*, with feature size, scale, and/or spacing configured for washing bristles of differently sized brushes in the alternate orientations of the flexible body. For example, washing features 66/68 and 86*a*/86*b* may be symmetrically arranged in a two-dimensional grid pattern or array on front and back medial portions 52 and 58 of flexible body 243, and configured for washing brushes by pushing the bristles against the pattern features in a circular motion.

Conversely, the textured patterns on surfaces 54, 60, 136 and 146 each comprise a plurality of elongate ridge structures 60, 80/82, 150 and 152, with various scales, feature sizes, and feature spacing configured for rinsing, finishing, refining and/or shaping bristles of differently sized brushes, in the alternate (reversed) orientations of the flexible body. For example, ridge structures 60, 80/82 and 150 may be arranged in a generally parallel pattern on each of surface regions 54, 60 and 136, with relatively larger or smaller spacing selected for rinsing or finishing brushes with relatively larger or smaller bristles by moving the bristles back and forth across (or between) the ridge features. Alternatively, ridge structures 152 may be arranged in a generally circular or concentric pattern on surface region 146, with spacing selected for refining, finishing and/or shaping brushes with relatively larger or smaller bristles.

Figure 15A:
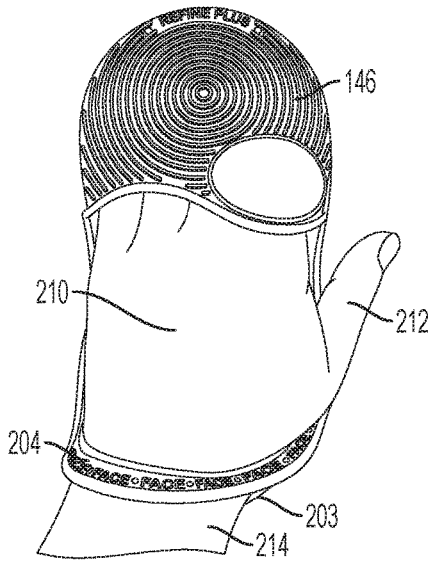
FIGS. 15A and 15B are front and rear views, respectively, of the reversible device worn on a hand.
Figure 15B:
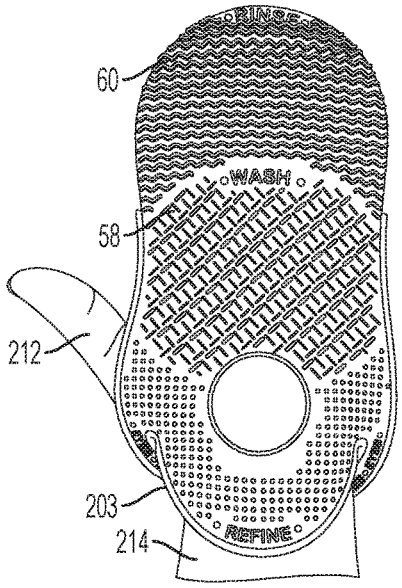

FIGS. 15A and 15B show reversible device 216 being worn on hand 210 in a first orientation. In this example, the fingers of hand 210 are placed within the pocket 201, and hand 210 is inserted through lower wrist opening 203 defined by a loop or strap 204 so lower wrist opening 203 is engaged with wrist 214. Lower wrist opening 203 may be included towards the proximal end of device 216 and can take the form of a slit cut into flexible body (or body panel) 243 or be defined by a wrist strap protruding from flexible body 243. A slit cut into flexible body 243 may be preferable because it would allow lower wrist opening 203 be flush with flexible body 243 when device 216 is not in use for a more compact device 216. The properties of lower wrist opening 203 and its surrounding area such as size, shape, and exact location and material of lower wrist opening 203 may vary depending on various design considerations such as overall size of device 216 or desired tightness of engagement between lower wrist opening 203 and wrist 214. Device 216 may be worn such that attachment points such as pocket 201 and wrist opening 203 may be helpful in maintaining the stability of device 216 during vigorous washing of brushes using rotating and back and forth movements.

Figure 16A:
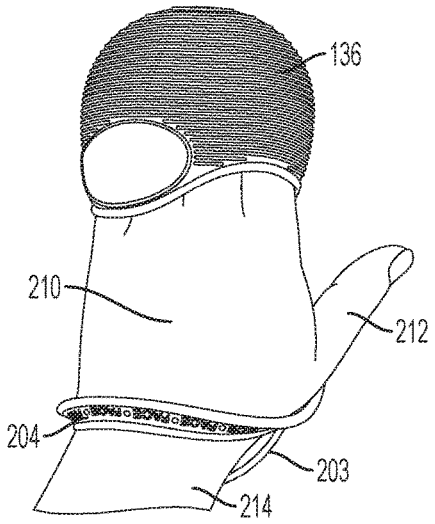
FIGS. 16A and 16B are front and rear views, respectively, of the reversible device being worn on a hand in the reversed orientation.
Figure 16B:
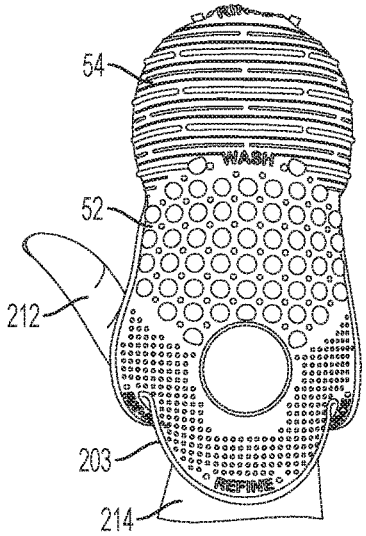

FIGS. 16A and 16B show device 216 being worn on hand 210 in a second orientation. After being reversed from a first to a second orientation, as can be seen by comparing FIGS. 16A and 16B with FIGS. 15A and 15B, some textured surface regions that would have been covered up by hand 210 are now exposed and available for use. As a specific example, in a first orientation, post-rinsing region 136 may have been facing hand 210 within pocket 201 and surface region 146 faces away from hand 210; however, after reversing device 216, post-rinsing region 136 arrives on the outside of pocket 201 and may be more accessible for washing, while surface region 146 faces hand 210 within pocket 201.

FIG. 17A demonstrates an embodiment of device 216 that includes lateral thumb opening 205 in two different locations on device 216. Lateral thumb opening 205 may be especially useful to maintain stability of device 216 during vigorous washing of brushes using rotating or back and forth movements. Lateral thumb opening 205 may accommodate insertion of thumb 212 and engagement between thumb 212 and device 216 for various purposes including stabilizing or controlling device 216. Having two lateral thumb openings 205 located in two different locations on device 216 may allow for the device to be used by both right- and left-handed users, as well as both configurations of device 216 to be used. A pair of opposing lateral thumb openings 205 may be included towards the medial portion of device 216 and can take the form of a slit cut into the media portion of flexible body 243 or be defined by loops or straps 207 defined along or protruding from flexible body 243. It may be preferable for lateral thumb opening 205 to be defined by a slit cut into flexible body 243 and/or a loop 207 presented on flexible body 243, allowing lateral thumb opening 205 to lie flush with flexible body 243 when device 216 is not in use, allowing for a more compact sized device 216. The properties of lateral thumb opening 205 and its surrounding area such as size, shape, and exact location and material of lateral thumb opening 205 may vary depending on various design considerations such as overall size of device 216 and desired tightness of engagement between lateral thumb opening 205 and thumb 212.

FIGS. 17B and 17C show device 216 being worn on hand 210 in a first orientation. In this example, hand 210 is attached to device 216 by pocket 201, lower wrist opening 203, and lateral thumb opening 205. Specifically, the fingers of hand 210 are placed within pocket 201, hand 210 is inserted through lower wrist opening 203 so the lower wrist opening 203 is engaged with wrist 214, and thumb 212 is inserted through lateral thumb opening 205.

Figure 18:
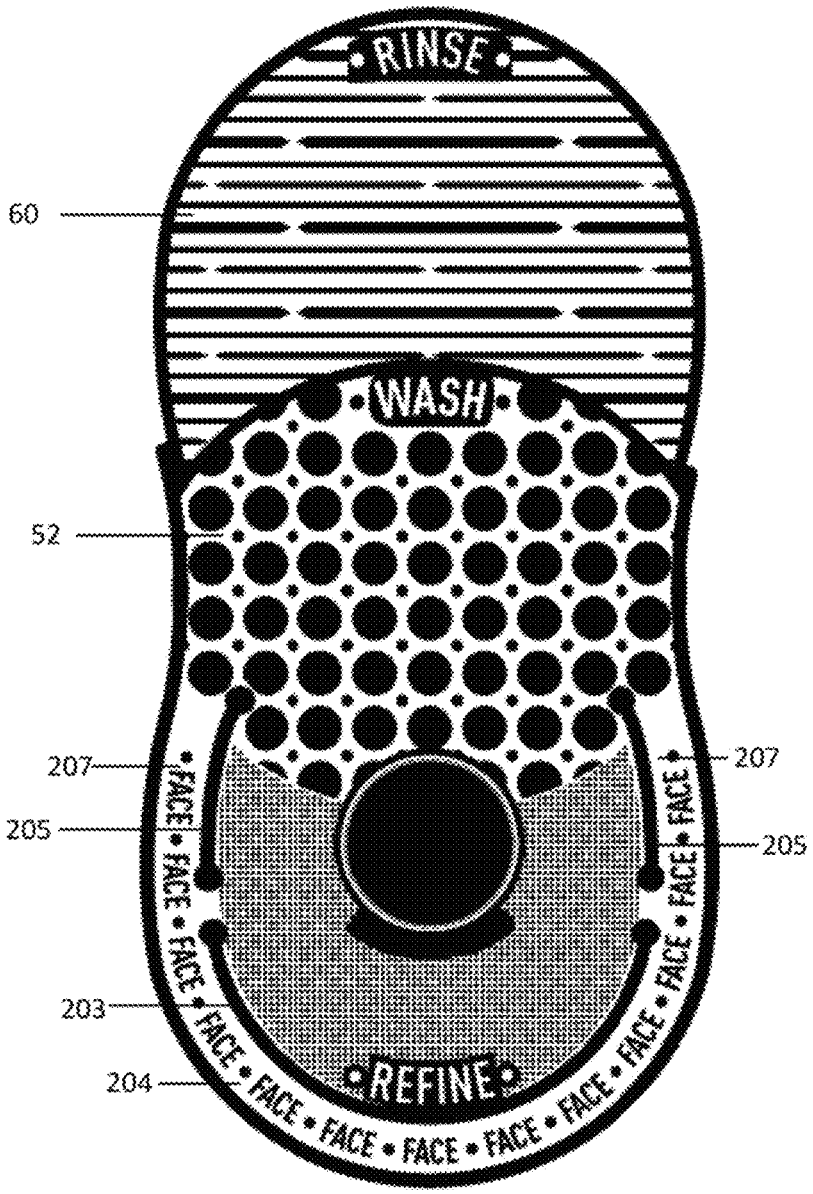
FIG. 18 is a rear view of the device shown in FIG. 17A, in a reversed orientation.

FIG. 18 shows device 216 with an alternate configuration of textures and attachment points. For example, texture does not extend past lower wrist opening 203 or lateral thumb opening 205.

Figure 19:
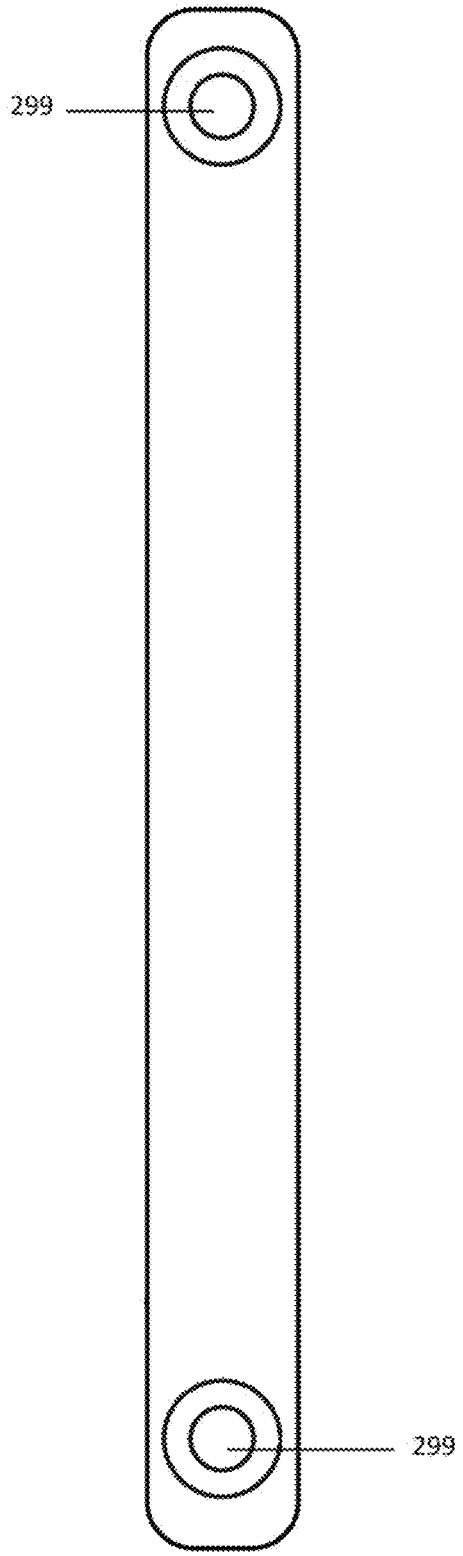
FIG. 19 is a detail view of a drainage hole for the reversible device.

FIG. 19 shows an example configuration of drainage hole 299. Drainage hole 299 may be placed at various locations in device 216 to drain water that may collect in pocket 201 during the brush washing process. For example, drainage hole 299 may be positioned in the material that forms the first and second sides 240 and 244 of reversible panel 241. The exact placements of drainage hole 299 and the other features, sizes and dimensions of device 216 are merely representative, and provided for exemplary purposes only.

Figure 20A:
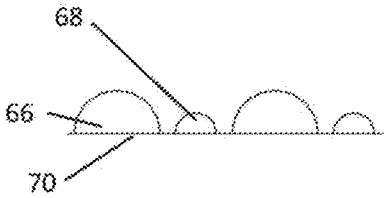
FIGS. 20A, 20B, 20C, 20D, 20E and 20F are schematic cross-sectional views of various brush treatment textures.

FIG. 20A shows a schematic view of larger nodules 66 and smaller nodules 68. Larger nodules 66 may extend 4.2 mm away from base 70 and have a 4.2 mm radius. Smaller nodules 68 may extend 2 mm away from base 70 and have a 2 mm radius. These numbers are for example purposes only, nodules 66 and 68 may come in various shapes and sizes as would be understood by one skilled in the art. This arrangement of nodules may be formed within surface region 52 and may preferentially be used to intensely and repeatedly cleanse residue from brushes. Due to the intensity of the movements in this area, surface region 52 may be placed toward a region of device 216 that would receive substantial support, for example, by a medial region of flexible body 243 supported by the palm of hand 210.

Figure 20B:
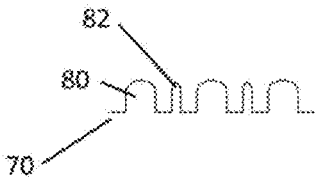

FIG. 20B illustrates an embodiment where ridges 80 and 82 take the form of a portion of a sphere extending above a cylinder. In this and other embodiments, the bar and ridges may extend 3.2 mm above the base 70. This measurement, however, is for example purposes only and the actual height and shape of ridges 80 and 82 may vary. Ridges 80 and 82 may be placed in surface region 54 of device 216 and may be used to provide surface contact with a brush moving in a back and forth motion at the rinsing stage. Surface region 54 may be preferentially placed in a region of device 216 near the fingers of hand 210 to provide sufficient levels of support and dexterous control to support this kind of motion.

Figure 20C:
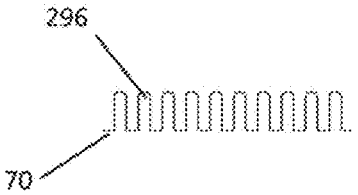

FIG. 20C is a cross-sectional view of circular ridges 152 that may take the form of substantially concentric circles arranged in, for example, surface region 146. Circular ridges 152 may have a height of 3.9 mm; however, other sizes may be used as desired. Surface region 146 may be arranged to facilitate the separation of small brushes to allow a cleansing solution to deeply penetrate the bristles to remove residue. Because this kind of cleansing action may most effectively come toward the end of the cleansing process and require a particular amount of strength and support, surface region 146 may preferentially be placed on first or second side 240 or 244 of reversible panel 241, for example so as to be supported by the back of the fingers of hand 210, when inserted into pocket 201.

Figure 20D:
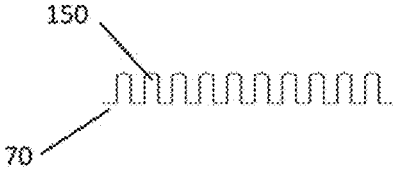

FIG. 20D is a cross-sectional view of elongate ridges or bars 150 that may take the form of substantially parallel lines arranged in, for example, post-rinsing region 136. Elongate ridges or bars 150 may have a height of 3 mm, but may be of different sizes as necessary. Post-rinsing region 136 may be arranged with a spacing and height to function as an aid to further clean large brushes. The particular amount of strength and support needed to facilitate this kind of cleaning action may be found at first or second front surface region 242 and 244 so as to be supported by, for example, the back of the fingers of hand 210.

Figure 20E:
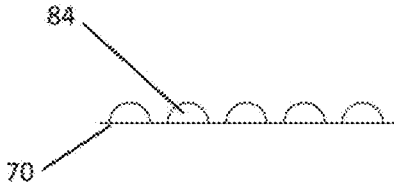

FIG. 20E shows a schematic view of bristles 84, which may be have a radius of 2 mm and a height in the direction away from base 70 of 2 mm. Bristles 84 may facilitate separation of adjacent bristles of brush 30, allowing a cleaning solution to penetrate the bristles more deeply. For this purpose, bristles 84 may be placed in proximal surface region 56 located at, for example, a portion of device 216 located near wrist 214 to provide strong support, but less dexterous control than a region, for example, located at a portion of device 216 near fingers of hand 210.

Figure 20F:
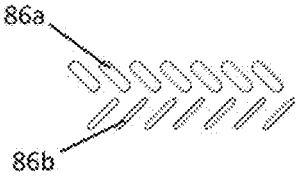

FIG. 20F shows an embodiment of ridges 86 that may be placed at, for example, surface region 58. In this embodiment, ridges 86*a* that are oriented in one direction are of a different size than ridges 86*b* oriented in a different direction. The configuration of ridges 86 may facilitate washing small brushes. The size, shape, density, and distribution of ridges 86 may provide a favorable texture for penetrating relatively small brush heads with a cleaning solution and to separate adjacent bristles and expose as much bristle surface area as possible to the solution. This region may be used with broad, vigorous circular motion and rotation of head 48 against surface region 58, while applying intense pressure to the head. The intermingling of nodules 86*a* and 86*b* increases the area of contact with the bristles and improves the wiping action, resulting in more efficient removal of makeup from the bristles. Due to the nature of the movements in surface region 58, it may be placed near an area of device 216 that would receive substantial support, for example, by a medial or palmar region of flexible body 243 supported by the palm of hand 210.

Figure 21:
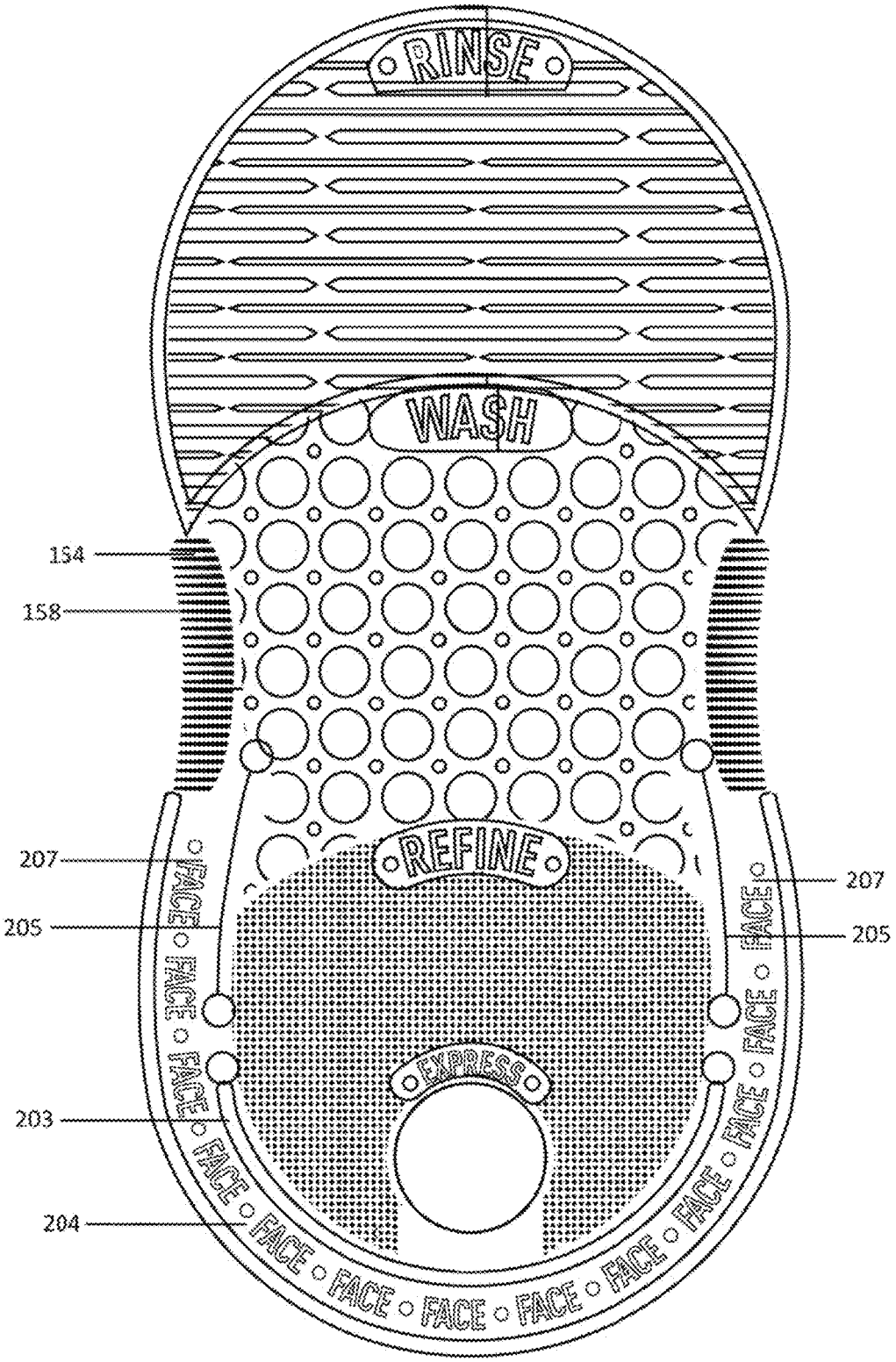
FIG. 21 is a rear view of the reversible device showing the symmetric thumb slots.

FIG. 21 shows a rear view of an embodiment of device 216 in a second orientation. The lateral portions of this embodiment of device 216 contain ridges 158 formed along shaping surface 154 extending generally parallel to frontal and rear panels. Shaping surface 154 may be used to remove excess moisture while also shaping the brush head by wiping brush 28 (or brush 30) against the ridges of shaping surface 154. The location of ridges 158 gives shaping surface 154 certain properties which may be beneficial. First, because ridges 158 may be formed by cutting laterally into to flexible body 243, their size and depth can be increased while maintaining the flatness of device 216, as opposed to having ridges 158 extending out of the front or rear faces of device 216, which may add to the overall thickness of the device. Additionally, because ridges 158 may extend generally parallel to the placement of hand 210, they can be of a size or shape that would otherwise have been uncomfortable or un-ergonomic. Further, this placement of ridges 158 enables them to maintain their relative location and access even after reversing device 216 from a first to a second orientation, which may allow device 216 to be designed without certain redundant duplicate portions that would otherwise be needed to access similar texture patterns in both the first and second orientations. This capability can be seen, for example by comparing FIG. 21 with FIG. 22.

Figure 22:
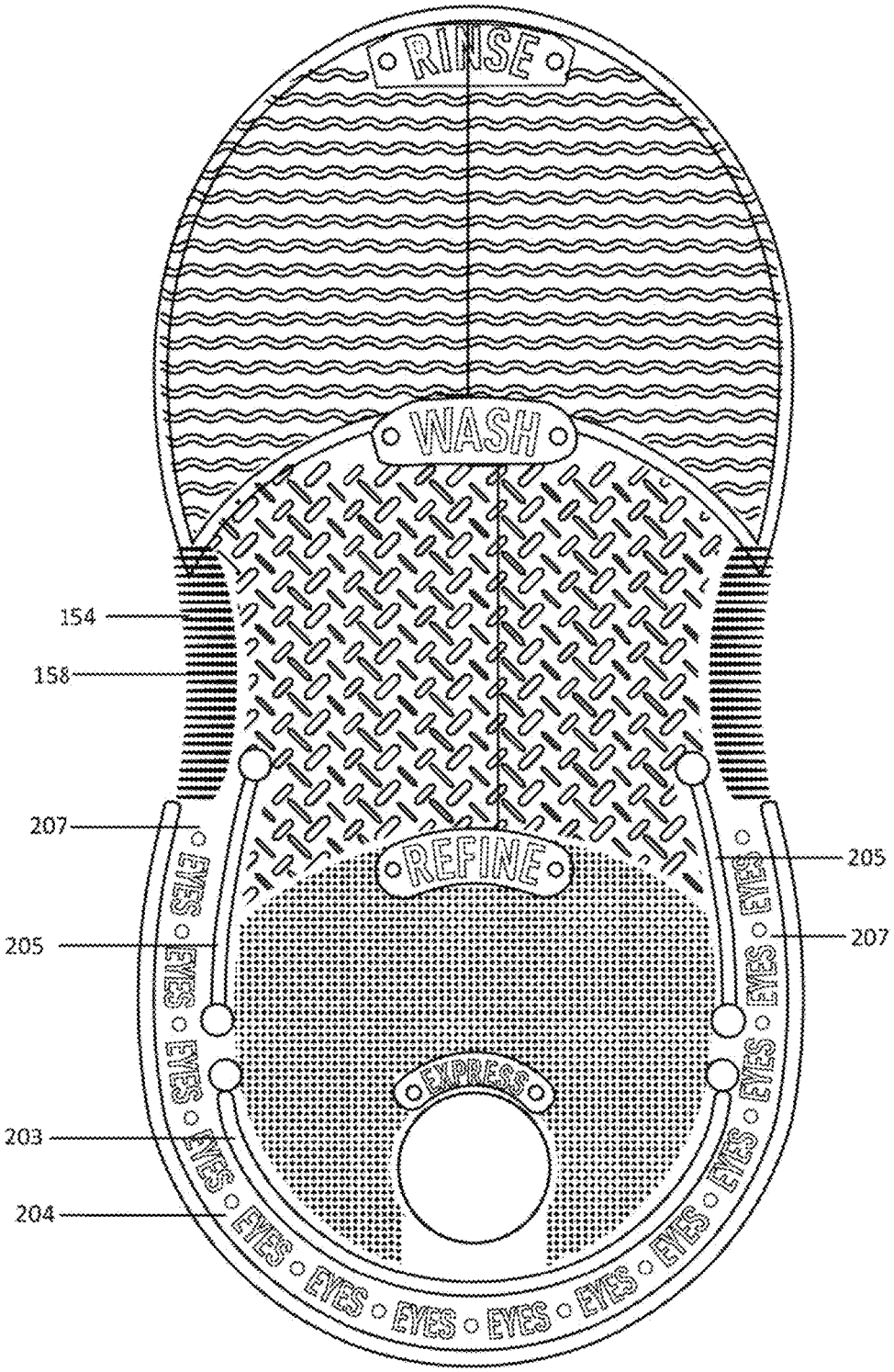
FIG. 22 is a rear view of the device in FIG. 21.

FIG. 22 illustrates a rear view of device 216 as shown in FIG. 21. In this view, it can be seen that ridges 158 formed along shaping surface 154 are still present even after reversing device 216 from a first to a second orientation.

Figure 23:
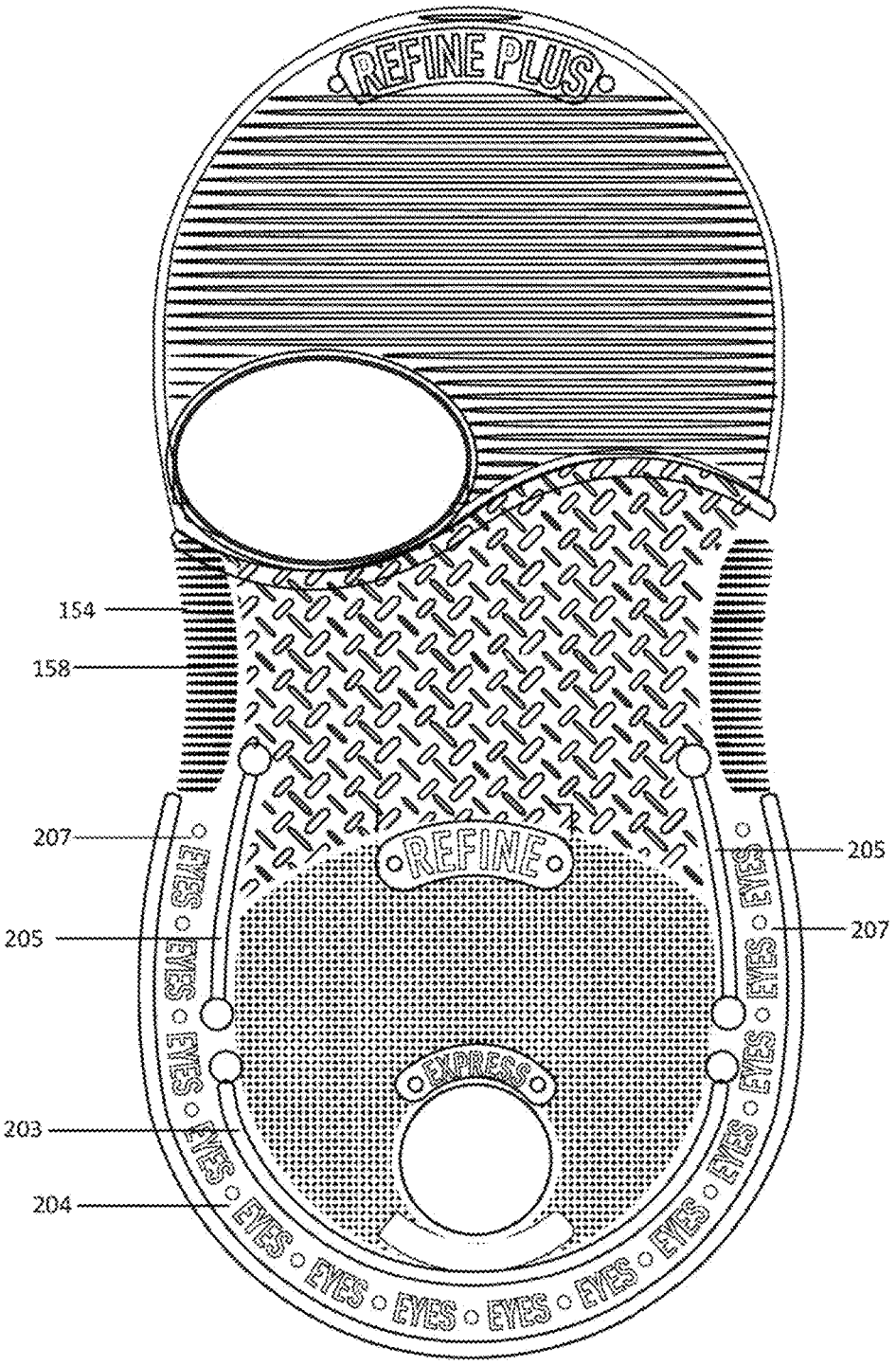
FIG. 23 is a front view of the device in FIG. 21, in a reversed orientation.
Figure 25:
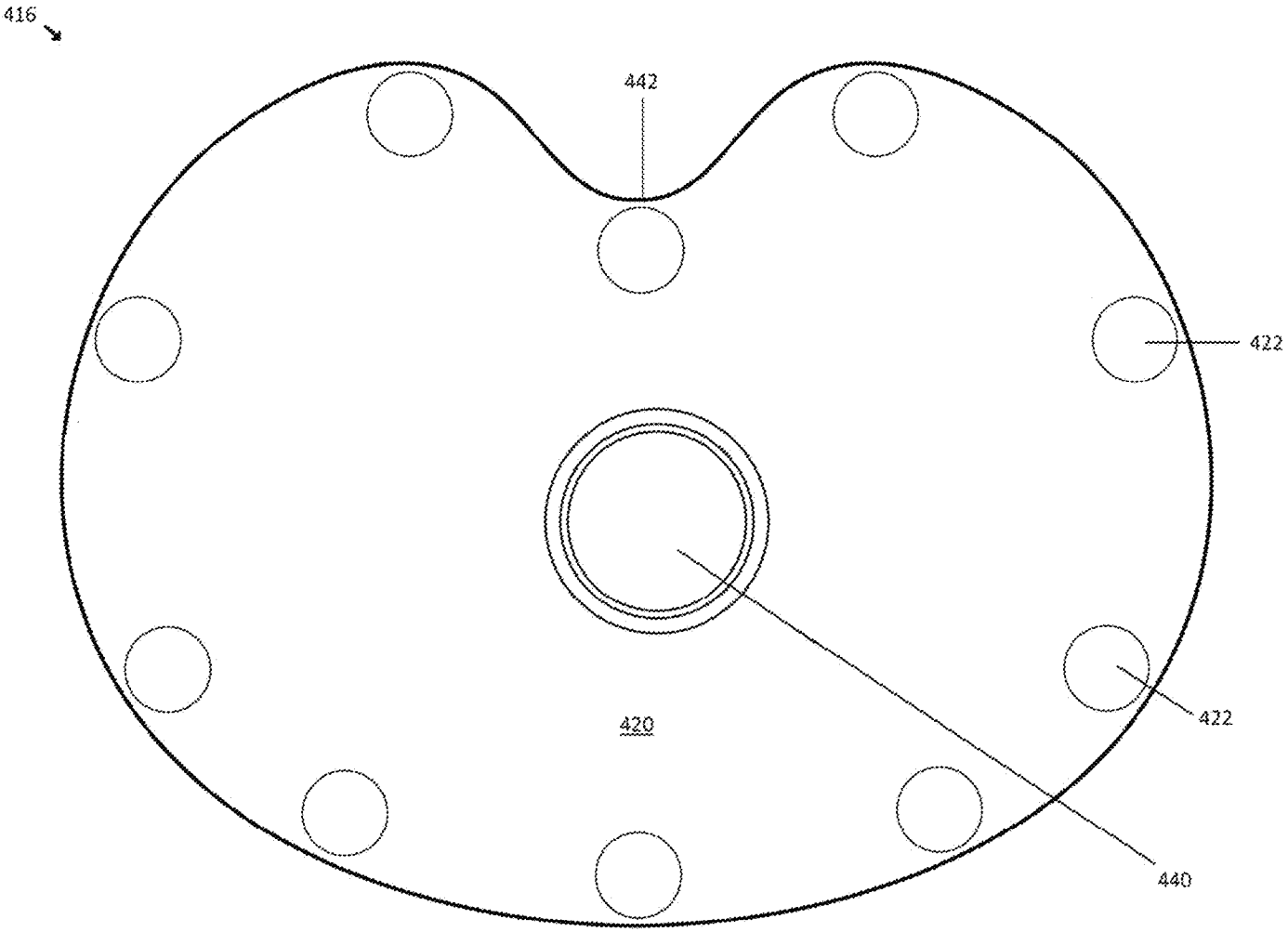
FIG. 25 is a bottom view of the device in FIG. 24.

FIG. 23 illustrates a front view of device 216 in a second orientation. This view demonstrates how, like devices 16, 94, and 120, device 216 may incorporates various combinations textured surfaces. In addition, FIG. 25 shows the availability of ridges 158 from the front view of device 216.

In addition to the configurations of embodiments disclosed above, first rear surface region 242 may include various other regions such as surface region 60 defined by parallel ridges 90, surface region 58 defined by bars 86*a* and 86*b*, surface region 56 defined by bristles 84, and other regions as desired. Second rear surface region 246 may include various other regions such as surface region 54 defined by ridges or bars 80 and 82, surface region 52 defined by larger nodules 66 and smaller nodules 68, surface region 56 and defined by bristles 84, and other regions as desired. The exact placement of the regions may vary depending on the desired purpose for the region. For example, regions used for particularly vigorous scrubbing may preferentially be placed towards the areas of device 216 where they may receive the most support by hand 210, for example the palmar region of device 216. Regions where a greater degree of control is desired may be placed in locations on device 216 most easily manipulated by the fingers of hand 210.

Examples—Mat Embodiments

Figure 24:
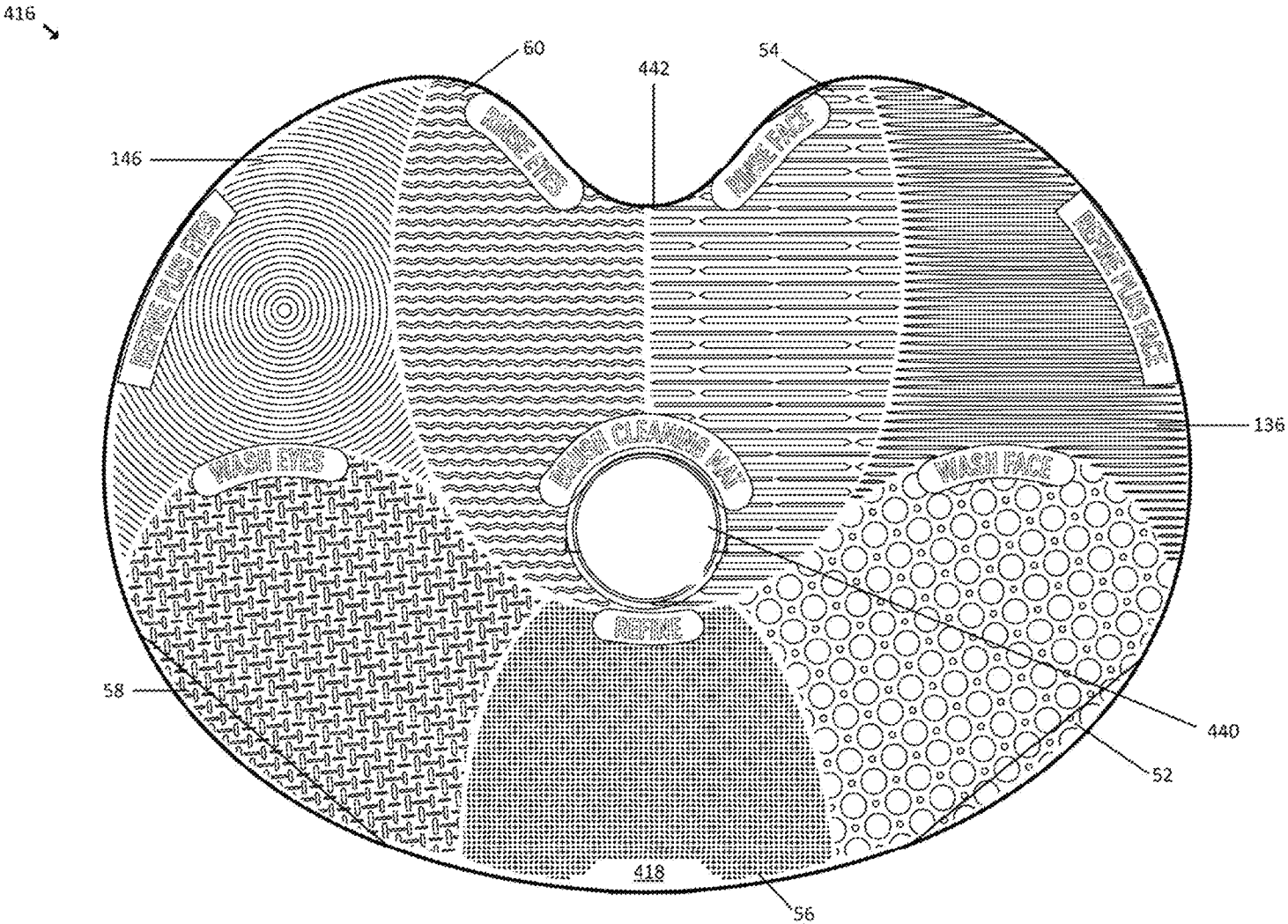
FIG. 24 is a top view of the brush cleaning device in a mat embodiment.

FIG. 24 illustrates a mat embodiment of brush cleaning device 416, which takes the form of a substantially flat surface or mat having a first (e.g., front) side 418, a second (e.g., rear or back) side 420, a concave region 442, and a drainage hole 440. This configuration may allow for easier cleaning of brushes in, for example, a sink, tub or basin. As another example, a device placed in the basin of a sink may have regions with differing drainage capabilities depending on the slope of the basin in the particular region. In one embodiment, device 416 may, when laid flat, be substantially oval or oblate in shape. Concave region 442 may help prevent device 416 from substantially bubbling, distorting, or warping when placed, for example, in a basin or sink with a curved bottom.

Front side 418 may include various textured regions for cleaning brushes such as, for example, surface region 60 defined by parallel ridges 90, surface region 58 defined by bars 86*a* and 86*b*, surface region 56 defined by bristles 84, surface region 54 defined by ridges or bars 80 and 82, surface region 52 defined by larger nodules 66 and smaller nodules 68, surface region 56 defined by bristles 84, and other regions as desired. The exact placement of the regions may vary depending on the desired purpose for the region. For example, regions designed to aid in the rinsing of brushes may preferentially be located close to where water is running; alternatively, regions designed to aid in the scrubbing of brushes may preferentially be located away from running water so the cleansing solution will not as easily be washed away.

FIG. 25 illustrates back or bottom side 420 of device 416, which may include a different pattern of textures from side 418 or may be substantially smooth. Back side 420 may also include fixation or positioning elements (or feet) 422 to prevent device 416 from slipping or sliding during use. Fixation elements 422 may include suction cups paced, for example, around the perimeter of device 416. Fixation elements 422 may also include textured surfaces, rubber, polymer, or other stiction ("grippy") elements, glue or removable adhesive, VELCRO fasteners, or other mechanical adhesion or fixing elements configured to maintain the position of mat device 416 with respect to the surface of a sink, basin or other work environment during vigorous brush cleaning and treatment steps.

Depending on embodiment, the mat device may include or be formed of a flexible body 416 having first (top/front) and second (bottom/back) sides or surfaces 418 and 420, respectively. A plurality of different brush treatment textures (or pattern areas) 52, 54, 56, 58, 60, 136 and 146 can provided on top surface 418, and variously configured for each of washing, rinsing and refining bristles of brushes with different sizes (that is, relatively larger and relatively smaller sizes, with respect to one another; e.g., eye and face brushes).

Bottom surface 420 includes one or more feet or other positioning elements 422, configured to maintain the position of device 416 with respect to the bottom of the skin, wash basin, or other work area.

A concave stress relief feature 442 is provided in the perimeter of flexible body 416, and configured to accommodate flexing of the device when the bottom surface positioned on the curved or angled (non-planar) bottom surface of the sink or basin. For example, stress relief feature 442 can be positioned along a medial line of the device, dividing the top surface into generally symmetric and opposing sides (e.g., on the left and right, as shown in FIGS. 24 and 25).

The different brush treatment surfaces 52, 54, 56, 58, 60, 136 and 146 include textures variously configured for rinsing and washing the bristles of relatively smaller brushes on the first side of the top surface, and for rinsing and washing bristles of relatively larger brushes on the second side. The two sides can be defined, for example, by the substantially symmetric left and right portions of top surface 418.

In specific embodiments, the different brush treatment surfaces include texture configured for refining the bristles of both larger smaller brushes, for example in medial portion 56 of top surface 418, where medial portion 56 extends at least partially onto each of the opposing sides. The different brush treatment surfaces can also include different textures configured for treating the bristles of relatively smaller and relatively larger brushes in a post-refining step, which is performed on the first and second opposing sides of top surface 418, respectively. These different textures may include generally concentric ridges arranged on the first side of top surface 418 to treat the bristles of relatively smaller brushes (textured surface 146), and generally parallel ridges arranged on the second side of the top surface to treat the bristles of relatively larger brushes (textured surface 136).

Textures configured for washing the bristles can include symmetric grid patterns 52 and 58 of different features selected for washing bristles of relatively smaller brushes on the first side of top surface 418 and relatively larger brushes on the second side of top surface 418, respectively. For example, some features selected for washing relatively smaller brushes include intersecting oblong ridge or bar features (e.g., 86*a*, 86*b*) arranged in a grid pattern 58 on the first side of top surface 418, and other features selected for washing relatively larger brushes include generally round (e.g., 66, 68), oval or lobed features arranged in a grid pattern 52 on the second side. Textures configured for rinsing bristles can include patterns of generally parallel ridges with different scales selected for relatively smaller brushes on the first side of top surface 418, and for relatively larger brushes on the second side of top surface 418.

In other embodiments the mat device can be configured for treating bristles of relatively smaller and relatively larger brushes with a flexible body 416 having a top surface 418, a bottom surface 420 and configured to drain water from the flexible body or mat 416, for example into the corresponding drain of a sink, tub or basin.

A stress relief feature 442 can be provided in the perimeter of flexible body 416, and configured to accommodate flexing of top and bottom surfaces 418 and 420 with respect to the work area (e.g., on a curved or non-planar surface). First and second pluralities of different brush treatment textures are provided on first and second sides. The different textures 58, 60 and 52, 54 are variously configured for washing and rinsing the bristles of relatively smaller and relatively larger brushes on the first and second sides of the device, respectively. Drain hole 440 can be positioned between textures 54 and 60 configured for rinsing the relatively larger and relatively smaller brushes, for example between the generally symmetric and opposed left and right sides of the mat.

An additional brush treatment texture can be provided for refining the bristles of both larger and smaller brushes, for example in medial portion 56 of top surface 418. Different brush treatment textures can also be configured for treating the bristles of relatively smaller and larger brushes in a post-refining step performed on the first and second sides, respectively. For example, a plurality of generally concentric ridges can be arranged on the first side (e.g., textured region 146), and a plurality of generally parallel ridges can be arranged on the second side (e.g., textured region 136).

In particular embodiments, textures configured for washing the bristles include symmetrically arranged grid patterns of different oblong, round, ridge, bar or lobed features (e.g., 66, 68, 86A, 86B, or other variations), which are selected for washing the bristles of relatively smaller and larger brushes on the first and second sides of the mat, respectively. The textures configured for rinsing the bristles can include patterns of ridges, for example with different spacing selected for rinsing relatively smaller and larger brushes on the first and second sides.

In use of the mat device, flexible body 416 can be placed in a wash basin, sink or other work area, positioned to drain water from top surface 418 into the sink or basin. The bristles of relatively smaller brushes are treated on one side of top surface 418 (e.g., the left or right side), and the bristles of relatively larger brushes are treated on the other side (e.g., the right or left side). The different sides have different brush treatment textures 52, 54, 58 and 60 configured for washing and rinsing the bristles of relatively smaller and larger brushes, respectively.

The bristles can be refined in a common or medial area 56, which is configured for both smaller and larger brushes. Post-refining treatments can be performed on the different sides of the device, for example using different brush treatment textures 136 and 146 for shaping and finishing the bristles of relatively smaller and relatively larger brushes, respectively In one particular example, the textures for washing bristles are formed of different symmetric grid patterns 58 and 52, and the textures for rinsing bristles are formed of different ridge patterns 60 and 54. Similarly, the textures for post-refining treatment may include different patterns of generally concentric and generally parallel ridges 146 and 136. Each of these washing, rinsing, and post-refining textures can also be selected for treating the bristles of relatively smaller and relatively larger brushes separately, on the first and second sides of top surface 418, respectively.

Generally, the various regions of the various embodiments of the disclosed devices may have different washing characteristics depending on their location on the device. For example, an area of a device near the front of fingers of a hand may have increased dexterous control and support compared to an area of a device near the back of the fingers of a hand which may have lower dexterous control and lower support. As another example, a device placed in the basin of a sink may have regions with differing drainage capabilities depending on the slope of the basin in the particular region. These washing characteristics may include ability to receive and provide support, ability to be used dexterously, ability to be used ergonomically, proximity to a water source, proximity to a drain, instinctual use and other characteristics relating to how and why the particular region may be a useful aid in cleaning, rinsing, refining, drying, or otherwise washing.

Similarly, the various textures or patterns formed in the various embodiments of the various devices may confer various cleaning characteristics. For example, a pattern with long trenches or grooves may encourage drainage of water or residue while other patterns may be configured to encourage a cleaning solution to stay in a particular region. Cleaning characteristics may include depth, height, displacement, spacing, thickness, durability, ability to generate lather, ability to generate suds, ability to encourage a cleaning solution to penetrate a brush's bristles, ability to separate a brush's bristles, ability to remove residue, ability to remove water from bristles, ability to drain water from a region, ability to encourage or facilitate a particular hand movement, and other characteristics relating to how and why the particular texture may be a useful aid in cleaning, rinsing, refining, drying, or otherwise washing. These texture patterns may include the various patterns disclosed above and other patterns of structures having varying levels of homogeneity, isotropy, and displacement. A given texture pattern may lend itself to a particular style of use ranging from rough, vigorous, and imprecise to light, weak, and precise.

The usefulness of such a device as described herein may be improved by forming particular textures in particular regions on the device based on synergy between the washing characteristics of a region and cleaning characteristics of a particular texture. As a general example, a texture designed for use with vigorous movements and gestures, may be preferentially placed in a region near the palm for maximum support. As a specific example, the first side region 240 of reversible panel 241 may include surface region 146 formed by circular ridges 152. A user may wear device 216 such that first side 240 of reversible panel 241 is located near the back of hand 210, an area that may provide less ergonomic support for vigorous washing movements and may be better suited to fine cleansing and rinsing. Similarly, second front surface region 244 may include post-rinsing region 136 formed by elongate bars 150. As another example, textures that are best combined with fine movements may be placed in a region near the fingers or even near the fingertips for maximum control.

While this disclosure describes exemplary embodiments of the invention, various changes can be made and equivalents may be substituted without departing from the spirit and scope thereof. As understood by those skilled in the art, modifications can also be made to adapt these teachings to different situations and applications, and to the use of other materials and methods, without departing from the essential scope of the invention. The invention is thus not limited to the particular examples that are disclosed, and encompasses all of the embodiments falling within the subject matter of the appended claims.

The invention claimed is:

1. A brush treatment device comprising:

a flexible body having first and second opposed surfaces defining a top and a bottom thereof; and a plurality of different brush treatment surfaces provided on the top of the flexible body, the different brush treatment surfaces variously configured for each of washing and rinsing bristles of brushes;

the flexible body configured to maintain a position of the device; and the flexible body configured to drain water from the top of the flexible body;

wherein the different brush treatment surfaces comprise different textures configured for rinsing and washing bristles of relatively smaller brushes on a first side of the flexible body, and for rinsing and washing bristles of relatively larger brushes on a second side of the flexible body;

wherein the different brush treatment surfaces further comprise a texture configured for refining the bristles of both the relatively larger and the relatively smaller brushes;

wherein the different brush treatment surfaces further comprise textures configured for post-refining treatment of the bristles of the relatively smaller and relatively larger brushes on the first and second sides, respectively; and wherein the textures configured for post-refining treatment comprise a plurality of generally concentric ridges arranged on the first side and a plurality of generally parallel ridges arranged on the second side.

2. The device of claim 1, further comprising a relief feature provided in a perimeter of the flexible body.

3. The device of claim 2, wherein the relief feature is positioned along a medial line dividing the top of the flexible body into generally opposing sides.

4. The device of claim 1, wherein the brush treatment surfaces configured for washing the bristles comprise symmetric grid patterns of different textures on first and second opposing sides, respectively.

5. The device of claim 4, wherein the different textures comprise oblong ridge or bar features arranged in a grid pattern on the first side and generally round, oval or lobed features arranged in a grid pattern on the second side.

6. The device of claim 4, wherein the brush treatment surfaces configured for rinsing the bristles comprise patterns of generally parallel ridges with different scales on the first and second sides, respectively.

7. A method of using a device for treating bristles of relatively smaller and relatively larger brushes, the method comprising:

providing the device, the device comprising a body having a top surface configured to drain water and accommodate flexing, a first plurality of different brush treatment textures configured for washing and rinsing the bristles of the relatively smaller brushes, and a second plurality of different brush treatment textures configured for washing and rinsing the bristles of the relatively larger brushes;

positioning the flexible body of the device, the flexible body configured to drain the water from the top surface;

treating bristles of the relatively smaller brushes on a first side of the flexible body having the different brush treatment textures configured for each of washing and rinsing the bristles of the relatively smaller brushes;

treating bristles of the relatively larger brushes on a second side of the flexible body having the different brush treatment textures configured for each of washing and rinsing the bristles of the relatively larger brushes; and refining the bristles of both the relatively smaller brushes and the relatively larger brushes.

8. The method of claim 7, wherein the brush treatment textures configured for rinsing the bristles of the relatively larger and relatively smaller brushes are provided on the first and second sides, respectively.

9. The method of claim 7, further comprising a brush treatment texture configured for refining the bristles of both the relatively larger and the relatively smaller brushes.

10. The method of claim 9, wherein the brush treatment textures comprise textures configured for treating the bristles of the relatively smaller and relatively larger brushes in a post-refining step.

11. The method of claim 10, wherein the textures configured for treating the bristles in the post-refining step comprise a plurality of ridges.

12. The method of claim 7, wherein the brush treatment textures comprise symmetrically arranged grid patterns of oblong, round, ridge, bar or lobed features.

13. The method of claim 12, wherein the brush treatment textures comprise patterns of ridges with different spacing.

14. The method of claim 7, further comprising performing a post-refining treatment of the bristles of the relatively smaller brushes and the relatively larger brushes on the first and second sides, respectively.

15. The method of claim 14, wherein:

the textures configured for washing the bristles comprise symmetric grid patterns of features selected for washing the relatively smaller and relatively larger brushes on the first and second sides, respectively; and the textures configured for rinsing the bristles comprise patterns of generally parallel ridges selected for rinsing the relatively smaller and relatively larger brushes on the first and second sides, respectively.

* * * * *